US006547893B1

(12) United States Patent
Itoh et al.

(10) Patent No.: US 6,547,893 B1
(45) Date of Patent: Apr. 15, 2003

(54) FE-NI BASED MATERIAL FOR SHADOW MASK

(75) Inventors: Tatsuya Itoh, Kanagawa (JP); Tsutomu Omori, Kanagawa (JP)

(73) Assignee: Nippon Yakin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/926,691

(22) PCT Filed: Jun. 9, 2000

(86) PCT No.: PCT/JP00/03765

§ 371 (c)(1),
(2), (4) Date: Dec. 4, 2001

(87) PCT Pub. No.: WO00/77269

PCT Pub. Date: Dec. 21, 2000

(30) Foreign Application Priority Data

Jun. 10, 1999 (JP) ..... 11-164395
Jul. 28, 1999 (JP) ..... 11-214017
Jul. 28, 1999 (JP) ..... 11-214018

(51) Int. Cl.[7] ..... C22C 38/08
(52) U.S. Cl. ..... 148/336; 420/94; 420/95
(58) Field of Search ..... 148/366; 420/94, 420/9 S

(56) References Cited

U.S. PATENT DOCUMENTS 5,127,965 A 7/1992 Inoue et al.

FOREIGN PATENT DOCUMENTS

| | | | | |
|---|---|---|---|---|
| JP | 363193440 A | * | 8/1988 | ..... C22C/38/00 |
| JP | 1-252725 | | 10/1989 | |
| JP | 2-117703 | | 5/1990 | |
| JP | 406057382 A | * | 3/1994 | ..... C22C/38/00 |
| JP | 6-264140 | | 9/1994 | |
| JP | 9-143625 | | 6/1997 | |
| JP | 11-50146 | | 2/1999 | |
| JP | 2933913 | | 5/1999 | |

OTHER PUBLICATIONS

English Language Abstract of JP 6–264140., Sep., 1994.
English Language Abstract of JP 11–50146., Feb., 1999.
English Language Abstract of JP 2933913., May, 1999.
English Language Abstract of JP 1–252725., Oct., 1989.
English Language Abstract of JP 2–117703., May, 1990.
English Language Abstract of JP 9–143625., Jun., 1997.

* cited by examiner

*Primary Examiner*—Deborah Yee
(74) *Attorney, Agent, or Firm*—Greenblum, Bernstein, P.L.C.

(57) ABSTRACT

It is a Fe—Ni based shadow mask material of Fe—Ni alloy or Fe—Ni—Co alloy used as a material for a color television cathode tube or the like, and relates to a material wherein the material has a texture that an X-ray intensity ratio Ir of cubic orientation (100)<001> to twinning orientation (221)<212> thereof in a (111) pole figure is a range of 0.5–5:1 and segregation of Ni, Mn or the like is less, and a section cleanness defined according to JIS G0555 is made to be not more than 0.05% to reduce the occurrence of streak or mottling in the etching.

21 Claims, 12 Drawing Sheets

Division position

| | | |
|---|---|---|
| 1. | 523.4667 | (221)<212> |
| 2. | 1046.9333 | |
| 3. | 1570.4000 | |
| 4. | 2093.8667 | |
| 5. | 2617.3335 | |
| 6. | 3140.8000 | |
| 7. | 3664.2666 | |
| 8. | 4187.7334 | |
| 9. | 4711.2002 | |
| 10. | 5234.6670 | |
| 11. | 5758.1333 | |
| 12. | 6281.6001 | |
| 13. | 6805.0669 | |
| 14. | 7328.5332 | (100)<001> |

(100)<001> X-ray intensity / (221)<212> X-ray intensity I r = 13.9

Fig.3 Division position

| | | |
|---|---|---|
| 1. | 594.4667 | |
| 2. | 1188.9333 | |
| 3. | 1783.4000 | (221)<212> |
| 4. | 2377.8667 | |
| 5. | 2972.3335 | |
| 6. | 3566.8000 | |
| 7. | 4161.2666 | |
| 8. | 4755.7334 | |
| 9. | 5350.2002 | |
| 10. | 5944.6670 | |
| 11. | 6539.1333 | |
| 12. | 7133.6001 | |
| 13. | 7728.0669 | |
| 14. | 8322.5332 | (100)<001> |

(100)<001> X-ray intensity / (221)<212> X-ray intensity I r = 4.66

Division position

| | | |
|---|---|---|
| 1. | 357.3333 | |
| 2. | 714.6667 | |
| 3. | 1072.0000 | |
| 4. | 1429.3334 | |
| 5. | 1786.6667 | |
| 6. | 2144.0000 | |
| 7. | 2501.3335 | |
| 8. | 2858.6667 | |
| 9. | 3216.0000 | |
| 10. | 3573.3335 | |
| 11. | 3930.6667 | |
| 12. | 4288.0000 | |
| 13. | 4645.3335 | (100)<001> |
| 14. | 5002.6670 | (221)<212> |

(100)<001> X-ray intensity / (221)<212> X-ray intensity  I r = 0.93

Division position

| | | |
|---|---|---|
| 1. | 320.8000 | |
| 2. | 641.6000 | |
| 3. | 962.4000 | |
| 4. | 1283.2000 | |
| 5. | 1604.0000 | (221)<212> |
| 6. | 1924.7999 | |
| 7. | 2245.5999 | |
| 8. | 2566.3999 | |
| 9. | 2887.2000 | |
| 10. | 3208.0000 | |
| 11. | 3528.7998 | |
| 12. | 3849.5999 | |
| 13. | 4170.3999 | |
| 14. | 4491.1997 | (100)<001> |

(100)<001> X-ray intensity / (221)<212> X-ray intensity  I r = 2.79

Division position

| | | |
|---|---|---|
| 1. | 174.0000 | |
| 2. | 348.0000 | |
| 3. | 522.0000 | |
| 4. | 696.0000 | |
| 5. | 870.0000 | (100)<001> |
| 6. | 1044.0000 | |
| 7. | 1218.0000 | |
| 8. | 1392.0000 | |
| 9. | 1566.0000 | |
| 10. | 1740.0000 | |
| 11. | 1914.0000 | |
| 12. | 2088.0000 | |
| 13. | 2262.0000 | |
| 14. | 2436.0000 | (221)<212> |

(100)<001> X-ray intensity / (221)<212> X-ray intensity  I r = 0.36

$$Ci_{Ni}s = \sqrt{\frac{1}{n}\sum_{i=1}^{n}(Ci_{Ni} - Ci_{Ni}ave.)^2}$$

Fig.11
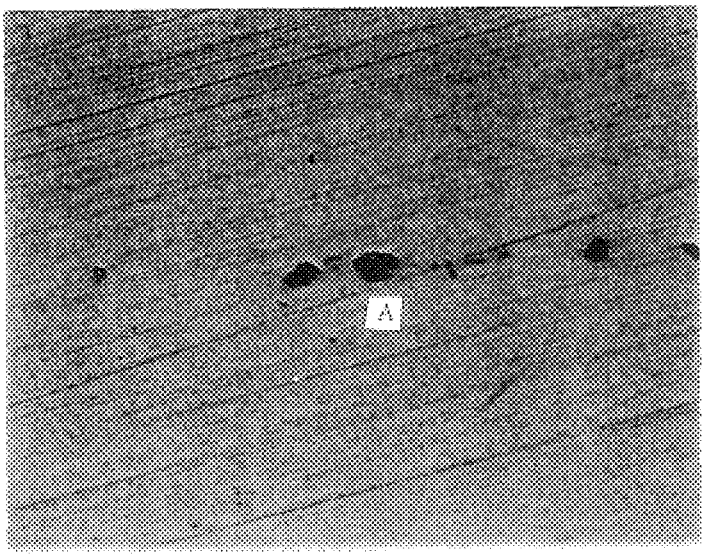
A16.2μm
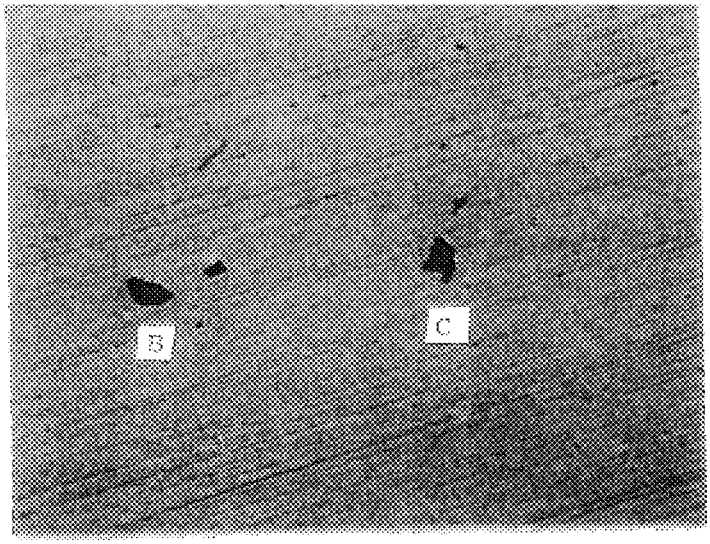
B15.5μm
C17μm
Microphotograph of inclusion on plate surface Microphotograph of inclusions at section

FE-NI BASED MATERIAL FOR SHADOW MASK

TECHNICAL FIELD

This invention relates to a Fe—Ni based material for shadow mask composed of Fe—Ni alloy or Fe—Ni—Co alloy used as a material for a cathode-ray tube of a color television and proposes a Fe—Ni based shadow mask material having such a low thermal expansion that streak or mottling (hereinafter referred to as streaks) is not caused in the photoetching with an etching solution consisting essentially of ferric chloride solution or the like.

BACKGROUND ART

Heretofore, low carbon aluminum-killed steel plates have been used as a material for shadow mask. These steel sheets are manufactured by subjecting a steel sheet after a middle cold rolling to an adequate strain-relief middle annealing in a continuous annealing furnace or a batch annealing furnace, and subjecting to an injury removal, if necessary, and thereafter subjecting to a finish cold rolling and a temper rolling (inclusive of dull rolling).

On the contrary, low thermal expansion type Fe—Ni alloy plates are recently noticed as a material for a cathode tube or a display of a high quality color television. This Fe—Ni alloy plate is developed instead of the low carbon aluminum-killed steel plate previously used as a material for a shadow mask. Such a Fe—Ni alloy is noticed in a point that the prevention of color drift is excellent as compared with the above low carbon aluminum-killed steel plate and is particularly one of inevitable materials in the applications of the display, large-size television and the like.

However, the Fe—Ni alloy has a problem in the photoetching property. That is, it is pointed out that the Fe—Ni alloy is poor in the pierced hole shape during the photoetching and is apt to easily cause the defect called as a streak. Particularly, it is known that the defect called as the streak generates strip-like contrast streak in a white portion of an image in a color television cathode tube to considerably lower the grade as a display. As the cause on the generation of the streak, there are considered the presence of non-metal inclusion and the influence of the Ni segregation. For this end, it is effective to remove these causes in order to mitigate these causes. However, even when these causes are removed completely, unsolvable streak still remains, so that the inventors thought another factor other than the above causes and studied thereto.

It is a main object of the invention to pinpoint a true cause of a streak or mottling (whole streak) produced by poor etching and provide a Fe—Ni based material for shadow mask not generating such streaks.

It is another object of the invention to provide a Fe—Ni based material for shadow mask made of Fe—Ni alloy or Fe—Ni—Co alloy having a good piercing property in the etching and a good hole shape in the piercing.

It is the other object of the invention to cheaply and surely provide a material for a color television cathode tube or a display developing a beautiful image.

DISCLOSURE OF THE INVENTION

The inventors have made various studies on the problems of the aforementioned streaks and the like, which have not been solved in the conventional technique, and obtained the following knowledge. That is, it has been confirmed that the streak or the like generated in the shadow mask material is based on the disorder of the orientation of individual crystal grains in the etched surface. And also, it has been confirmed that the disorder of the orientation results from segregation of Ni, Mn or the like, the residue of mixed grain structure of non-metal inclusion and coarse grains produced in the course of the annealing, the presence of specified texture and the like or is generated by interengaging these factors. Furthermore, the orientation of such crystal grains is dependent upon the crystal orientation inherent to the individual crystal grains, so that it is concluded that it is required to unavoidably control the texture for preventing the occurrence of the above streak or the like.

And also, the inventors have recognized that the control of section cleanness of the product or surface roughness and control of inclusion are further inevitable for improving the piercing property in the etching and the hole shape after the piercing and concluded that the controls of the section cleanness, surface roughness and inclusion are required in addition to the control of segregation of various components and texture.

Furthermore, it has been found that the streak can stably be mitigated by controlling the segregation distribution of Ni, Mn and the like in a thickness direction, and as a result the invention has been accomplished.

The invention is a material having the following construction developed under the above knowledge.

① The invention is a Fe—Ni based material for shadow mask of an iron-nickel alloy containing Ni: 34–38 wt %, characterized in that the material has a texture that an X-ray intensity ratio Ir of cubic orientation (100)<001> to twinning orientation (221)<212> thereof in a (111) pole figure is a range of 0.5–5:1 and a section cleanness defined according to JIS G0555 is not more than 0.05%.

② The invention is a Fe—Ni based material for shadow mask of an iron-nickel alloy having a composition of C: not more than 0.1 wt %, Si: not more than 0.5 wt %, Mn: not more than 1.0 wt %, Ni: 34–38 wt % and the remainder being substantially Fe, characterized in that the material has a texture that an X-ray intensity ratio Ir of cubic orientation (100)<001> to twinning orientation (221)<212> thereof in a (111) pole figure is a range of 0.5–5:1 and a section cleanness defined according to JIS G0555 is not more than 0.05%.

③ The invention is a Fe—Ni—Co based material for shadow mask of an iron-nickel-cobalt alloy having a composition of Ni: 23–38 wt %, Co: not more than 10 wt % and the remainder being substantially Fe, characterized in that the material has a texture that an X-ray intensity ratio Ir of cubic orientation (100)<001> to twinning orientation (221)<212> thereof in a (111) pole figure is a range of 0.5–5:1 and a section cleanness defined according to JIS G0555 is not more than 0.05%.

In the materials according to the invention, the X-ray intensity ratio (X-ray count number ratio) is basically 0.5–5:1 as mentioned above, but is recommended that the ratio is preferably restricted to ranges of 0.5–4.5:1, 1–4.5:1, 1–4.0:1 and 1.5–4.0:1 and more preferably adjusted to a range of 2–3.5:1.

The above materials ①, ② and ③ can be produced, for example, by treating an alloy comprising Ni: 34–38 wt % and the remainder being substantially Fe according to a usual manner to obtain a cold rolled material and subjecting to such an annealing that it is subjected to a middle annealing at an annealing temperature of 900–1150° C. for a soaking time of 5–60 seconds and then to a finish annealing at an annealing temperature of 700–900° C. for a soaking time of 60–600 seconds prior to a finish rolling.

Moreover, in the above production method, it is preferable to conduct each of the annealing conditions within a range enclosed in a, b, c, and d of FIG. 1.

And also, in the materials ①, ② and ③, it is effective to satisfy the followings:

a. surface roughness is 0.2 μm≦Ra≦0.9 μm;

b. surface roughness is 20 μm≦Sm≦250 μm;

c. surface roughness is −0.5≦Rsk≦1.3.

Further, in the materials ①, ② and ③, it is recommended to satisfy the followings:

d. surface roughness is 0.2 μm≦Ra≦0.9 μm and −0.5Rsk≦1.3;

e. surface roughness is 0.2 μ≦Ra≦0.9 μm, −0.5≦Rsk≦1.3 and 20 μm≦Sm≦250 μm.

Moreover, in the materials ①, ② and ③, it is favorable to satisfy the followings:

f. number of inclusions having a grain size of not less than 10 μm as measured on a section of the plate is not more than 80 grains per unit area of 100 $mm^2$;

g. number of inclusions having a grain size of not less than 10 μm as measured on a section of the plate is not more than 60 grains per unit area of 100 $mm^2$;

h. crystal grain size number as measured by a method according to JIS G0551 is not less than 7.0.

i. In general, the thickness of the shadow mask material is 0.01–0.5 mm, preferably 0.1 . 0.5 mm.

Moreover, the other material according to the invention has the following construction.

④ The invention is a Fe—Ni based material for shadow mask of an iron-nickel-alloy containing Ni: 34–38 wt %, Si: not more than 0.5 wt %, Mn: not more than 1.0 wt % and P: not more than 0.1 wt %, characterized in that the material has a texture that an X-ray intensity ratio Ir of cubic orientation (100)<001> to twinning orientation (221)<212> thereof in a (111) pole figure according to Shutz refractory process is a range of 0.5–5:1 and Ni segregation amount $C_{Ni}s$ defined in FIG. 11 in a thickness direction is not more than 0.30% and maximum Ni segregation amount $C_{Ni}max$ is not more than 1.5%.

Moreover, in the material ④ according to the invention, the X-ray intensity ratio (X-ray count number ratio) is basically 0.5–5:1 as mentioned above, but is preferable that the ratio is restricted to ranges of 0.5–4.5:1, 1–4.5:1, 1–4.0:1 and 1.5–4.0:1.

In the material ④ according to the invention, segregations of various components in the thickness direction of the material, i.e. segregations of Ni, Si, Mn and P are favorable to be within ranges represented by the following formulae (1) and (2).

A. As to Ni (1) satisfy segregation amount $C_{Ni}s$≦0.30(%);

(2) satisfy maximum segregation amount $C_{Ni}max$≦1.5 (%).

B. As to Si (1) satisfy segregation amount $C_{Si}s$≦0.002(%);

(2) satisfy maximum segregation amount $C_{Si}max$≦0.01 (%).

C. As to Mn (1) satisfy segregation amount $C_{Mn}s$≦0.010(%);

(2) satisfy maximum segregation amount $C_{Mn}max$≦0.05 (%).

D. As to P (1) satisfy segregation amount $C_P$s 0.001(%);

(2) satisfy maximum segregation amount $C_P$max≦0.005 (%).

Moreover, the segregation amount of each component, for example $C_{Ni}s$, $C_{Ni}max$ are values defined as follows (see FIG. 8 relating to detail definition).

(1) Segregation amount $C_{Ni}s$ (%)=Ni analytical value (%)×$Ci_{Ni}s/Ci_{Ni}ave$.

(2) Maximum segregation amount $C_{Ni}max$ (%)=Ni analytical value (%)×$Ci_{Ni}max/Ci_{Ni}ave$.

$Ci_{Ni}s$: standard deviation of X-ray intensity (c.p.s.)

$Ci_{Ni}ave.$: average intensity of total X-ray intensity (c.p.s.)

$Ci_{Ni}max$: maximum X-ray intensity (c.p.s.) (=maximum value−minimum value in X-ray intensity)

$Ci_{Ni}ave.$: average intensity of total X-ray intensity (c.p.s.)

Ni analytical value (%) is a Ni content included in the material and a value analyzed by chemical (or physical) means or the like.

The material ④ can be produced by subjecting a slab of an alloy having a given composition to a homogenizing heat treatment at a higher temperature of 1250–1400° for at least 40 hours to obtain a hot rolled plate, cold rolling the plate, and subjecting the cold rolled plate to such an annealing that it is subjected to a middle annealing at an annealing temperature of 900–1150° C. for a soaking time of 5–60 seconds and further to a finish annealing at an annealing temperature of 700–900° C. for a soaking time of 60–600 seconds prior to finish rolling. Moreover, it is desirable to conduct each of the above annealing conditions within a range enclosed by a, b, c, and d in FIG. 1.

And also, the material ④ according to the invention is favorable to satisfy the followings:

a. parameter Ra as a surface roughness is 0.2 μm≦Ra≦0.9 μm;

b. parameter Sm as a surface roughness is 20 μm≦Sm≦250 μm;

c. parameter Rsk as a surface roughness is −0.5≦Rsk≦1.3;

d. parameter Rθa as a surface roughness is 0.01≦Rθa≦0.09;

e. section cleanness defined in JIS G0555 is not more than 0.05%;

f. number of inclusions having a grain size of 10 μm as measured on a section of the plate is not more than 80 grains per unit area of 100 $mm^2$;

g. number of inclusions having a grain size of 10 μm at a position polished from a plate surface to a given depth is not more than 65 grains per unit area of 100 $mm^2$;

h. crystal grain size number measured by a method according to JIS G0551 is not less than 7.0.

Moreover, the thickness of the shadow mask material is usually 0.01–0.5 mm, preferably 0.05–0.5 mm.

BRIEF DESCRIPTION OF THE DRAWINGS

FIG. 11 is a microphotograph showing an example of large size inclusions on a surface of an alloy plate.

BEST MODE FOR CARRYING OUT THE INVENTION

Figure 1:
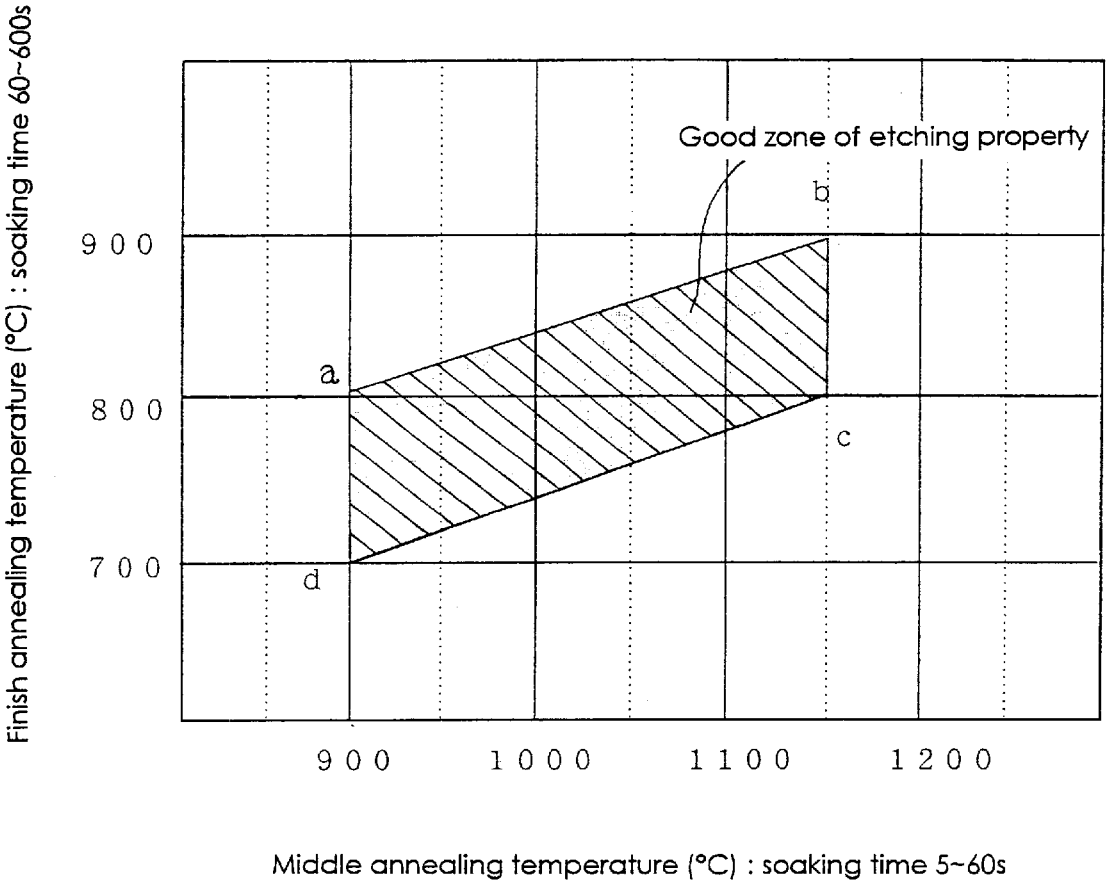
FIG. 1 is a graph showing a relationship for adequate range between middle annealing condition and finish annealing condition according to the invention.

As the streak to be examined in the invention, there are mainly an unevenness resulted from so-called segregation that a width of relatively individual streaks is seen thick, and streak resulted from so-called crystal orientation (silky streak) that a relatively thick streak is seen in a fine silky form. And also, a form of mixing both the streaks with each other is existent. The invention notices "streak" resulted from the segregation and "streak" depended by the crystal orientation and attempts to improve them.

As the Fe—Ni based material for shadow mask according to the invention are used those having the following composition.

When C content is not less than 0.1 wt %, a carbide is precipitated to not only obstruct the etching property but also badly affect the shape holdability after the formation of the shadow mask. When the C content is too large, the proof strength rises to increase the spring-back and hence the draping to a mold in the formation is degraded. In the invention, therefore, the C content is favorable to be not more than 0.1 wt %.

Si is a deoxidizing component, but when the content is too large, the hardness of the material itself increases and the shape formability is badly affected likewise C, and as the content becomes large, the rise of proof strength is caused to increase the spring back. Furthermore, it affects the streak in the etching, and the large content causes the occurrence of the streak. In the invention, therefore, the Si content is favorable to be not more than 0.5 wt %.

Mn is a deoxidizing component and bonds S, which is harmful in the hot formability, to form MnS, so that the hot formability is improved by adding an adequate content of Mn. However, as the addition amount becomes large, thermal expansion coefficient increases and also Curie point changes into a higher temperature side. In the invention, therefore, the Mn content is favorable to be not more than 1.0 wt %.

Ni is a most important component in the invention. When the Ni content is less than 34 wt %, thermal expansion coefficient becomes large and also martensite transformation is caused to fear the occurrence of the etching streak. On the other hand, when the Ni content is more than 38 wt %, thermal expansion coefficient becomes large and there is a problem that color unevenness is caused when being applied to a color television cathode tube or the like. Therefore, the Ni content is 34–38 wt % in order to improve the good etching property and the grade to color unevenness in the color television cathode tube.

And also, the invention is applicable to a Fe—Ni—Co based alloy so-called as a super amber having a typical composition of Fe-32 wt % Ni-5 wt % Co in addition to an amber material typifying the above 36 wt % Ni—Fe alloy. In this alloy, low thermal expansion characteristic is better and a cathode tube using such an alloy develops a more clear image.

In case of the Fe—Ni—Co based alloy, Ni is favorable to be 23–38 wt %. Preferably, the lower limit of Ni is not less than 25 wt %, particularly not less than 27 wt %, more particularly not less than 30 wt %. The preferable upper limit of Ni is not more than 36 wt %, more particularly not more than 35 wt %.

Co is favorable to be not more than 10 wt %. When the content exceeds the above value, the thermal expansion coefficient becomes higher and the etching property considerably lowers. Preferably, it is not more than 8 wt %, particularly not more than 7 wt %, more particularly not more than 6 wt %.

In case of examining the lower limit of Co, it is not less than 0.5 wt %, preferably not less than 1 wt %, more preferably not less than 1.5 wt %, further preferably not less than 2 wt %, more particularly not less than 2.5 wt %, most preferably not less than 3 wt %.

Moreover, the total content of Ni and Co is effective to be defined to 32–38 wt %.

Then, in order to suppress "streak" depending upon the crystal orientation, the invention controls the texture by introducing twinning orientation of (100) face in a cubic orientation to divide the cubic orientation to thereby remove the disorder of the crystal grain orientation.

That is, when the occurrence of the streak results from the crystal orientation, the streak is largely affected by the orientation of the crystal, so that it is desirable to ensure accumulation of cubic orientation (100)<001> as an etching preferential orientation to a certain level, but if such an orientation is too accumulated, it inversely renders into a structure having a fibrous directionality and degrades the streak grade and hence it is seen that the presence of twinning orientation being (221)<212> sub-orientation is required for assisting the adequate diffusion of the texture.

When the texture suitable as the material for shadow mask according to the invention is represented by X-ray intensity ratio Ir of (100)<001> cubic orientation to (221)<212> sub-orientation in the (111) pole figure, the adequate range is 0.5–5:1, preferably 1–4.5:1, more preferably 1–4.0:1, more particularly 1.5–4.0:1 as X-ray intensity ratio (X-ray count number ratio Ir) in the (111) pole figure. The best ratio is 2–3.5:1 for the production of the shadow mask material having an excellent streak grade.

In the invention, the measurement of the X-ray intensity ratio Ir and the measuring conditions thereof are as follows.

Firstly, in the measurement of the X-ray intensity ratio Ir, one surface of a plate is covered with a Teflon sheet and the other surface is subjected to a chemical polishing with a commercially available chemical polishing solution (C.P.E1000, made by Mitsubishi Gas Kagaku Co., Ltd.) so as to reduce the plate thickness to 70–30% as a measuring surface. It is desirable to measure a neighborhood of a central portion of the plate thickness as the measuring surface.

With respect to the thus obtained sample surface after the chemical polishing, the measurement of (111) poles through Schulz refraction process is carried out under the measuring conditions of the following Table 1, and then a ratio of X-ray intensity of (100)<001> orientation and X-ray intensity of (221)<212> orientation is determined based on the thus obtained pole figure. Each of the X-ray intensities is defined by measuring maximum X-ray intensity (maximum X-ray count number) and dividing this intensity into 15 equal parts and reading a contour intensity corresponding to intensities of (100)<001> and (221)<212> from the obtained pole figure.

Then, the X-ray intensity ratio Ir is calculated from the thus obtained intensities of (100)<001> orientation and (221)<212> orientation. Moreover, the X-ray intensity ratio Ir is defined as follows. Ir=X-ray intensity of cubic orientation (100)<001>/X-ray intensity of twinning orientation (221)<212>

TABLE 1

| Item | Measuring condition |
|---|---|
| X-ray generating source | CuKα/acceleration voltage: 35 kV, tube current: 30 mA |
| α-angle scanning range | 15–90°/5.0° step |
| β-angle scanning range | 0°/360° |
| γ vibration width | 10 mm |
| 2θ fixed angle* | 43.7° *:maximum angle of (111) diffraction intensity |

The pole figure acceptable or unacceptable to the invention is explained below.

Figure 2:
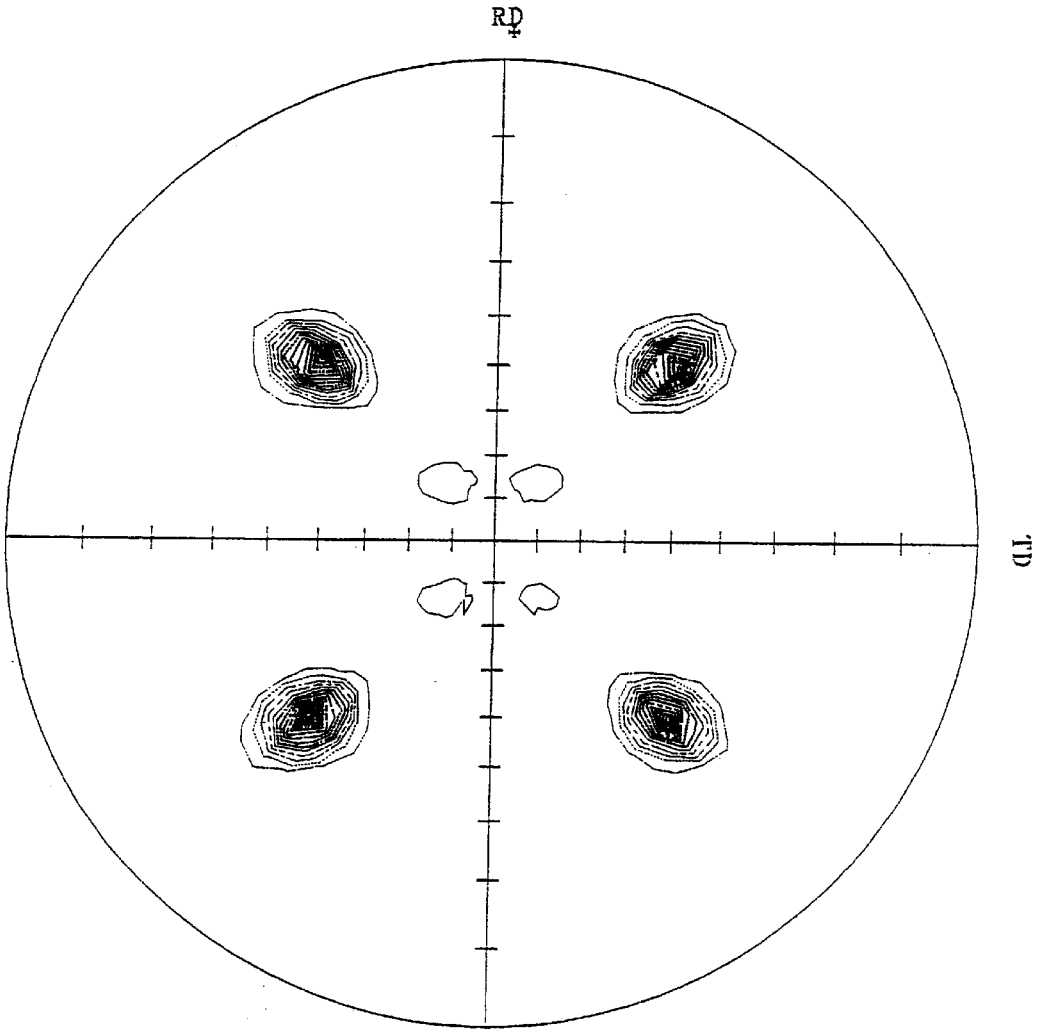
FIG. 2 is a (111) pole figure of a Comparative Material 11.

FIGS. 2–6 show pole figures of invention materials Nos. 1, 3, 4 and comparative materials Nos. 6, 11 made from Fe—Ni based material having a composition as shown in Table 2 under conditions shown in Table 3. FIG. 2 shows a pole figure of comparative material No. 11 in Table 3, wherein (100)<001> cubic orientation is more developed and the X-ray intensity ratio Ir to (221)<212> twinning orientation is 13.91. With respect to the etching property of this sample (comparative material 11), the mottling is good because the etching rate is fast as shown in Table 3, while the streak is clearly observed and hence the material is unsuitable as an actual shadow mask product.

TABLE 2

| Composition (wt %) | | | | |
|---|---|---|---|---|
| Ni | C | Si | Mn | Fe |
| 36.2 | 0.01 | 0.2 | 0.7 | Bal. |

orientation is very weak and the standardized intensity ratio is 0.36:1. With respect to the etching property of the comparative material No. 6, the grade of mottling is bad and hence this material is unsuitable as a shadow mask material.

Figure 7:
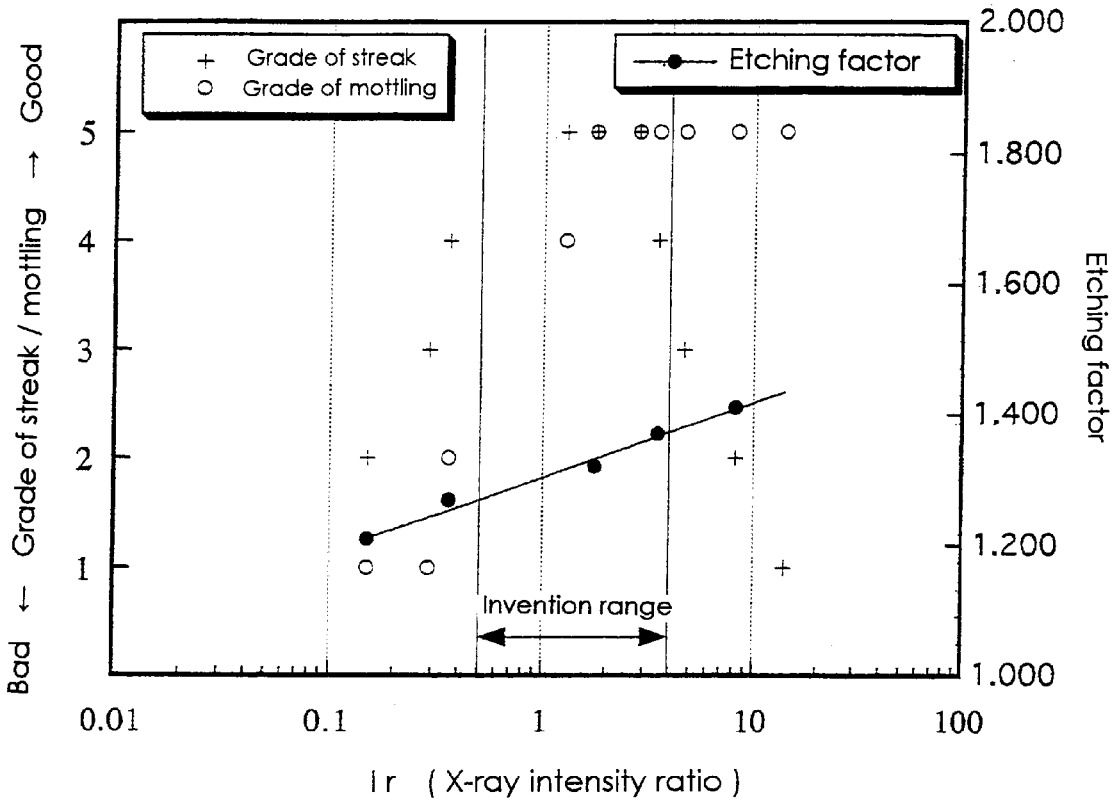
FIG. 7 is a graph showing a relation among Ir, etching factor and grade of streak and mottling.

FIG. 7 shows the above relations at a time. In this figure, an abscissa is a logarithm of the X-ray intensity ratio Ir and an ordinate is an etching factor (value obtained by dividing an etching amount in depth direction by an etching amount in width direction (side etch) in the pattern etching) and grades of streak and mottling. As shown in this figure, it is seen that the etching factor (etching rate in the thickness direction) increases as the X-ray intensity ratio Ir becomes larger (or the ratio of twinning decreases). On the other hand, the grade of streak is degraded when the X-ray intensity ratio Ir is too large or too small. As seen from the results of this figure, the adequate range of the X-ray intensity ratio Ir is 0.5–5. Moreover, the mottling is advantageous as the etching rate becomes large, but as seen from this figure, it is considered that when Ir exceeds approximately 1.0, the large change is not caused and there is no difference.

The invention defines the adequate range of the orientation component in such a pole figure, whereby the occurrence of whole streak called as streak and mottling in the etching of the material for shadow mask is prevented.

The method of orienting the crystal grains for providing the above texture is described below.

Firstly, an alloy material having a given composition is hot rolled according to a usual manner, and subjected to recrystallization annealing, pickling or the like, if necessary, and thereafter subjected to a middle (primary) cold rolling and then to a middle annealing prior to finish (secondary) rolling. Such a middle annealing is carried out for properly controlling the growth of crystal having a cubic orientation of (100)<001>. The middle annealing is conducted at a

TABLE 3

| | Thickness (mm) | Middle annealing temperature (° C.) | Soaking time of middle annealing (s) | Finish annealing temperature (° C.) | Finish rolling thickness (mm) | Soaking time of finish annealing (s) | Intensity ratio Ir (100)<001>/(221)<212> | Grade of streak | Grade of mottling |
|---|---|---|---|---|---|---|---|---|---|
| Invention materials | | | | | | | | | |
| 1 | 1.2 | 950 | 25 | 750 | 0.132 | 120 | 0.93 | 5 | 4 |
| 2 | 1.0 | 1050 | 40 | 850 | 0.133 | 200 | 1.27 | 5 | 4 |
| 3 | 0.98 | 1025 | 35 | 780 | 0.135 | 350 | 4.66 | 4 | 5 |
| 4 | 1.15 | 1070 | 15 | 800 | 0.125 | 180 | 2.79 | 5 | 5 |
| 5 | 1.25 | 925 | 50 | 820 | 0.140 | 90 | 1.75 | 5 | 5 |
| Comparative materials | | | | | | | | | |
| 6 | 1.23 | 1250 | 45 | 800 | 0.128 | 78 | 0.36 | 4 | 2 |
| 7 | 1.05 | 1050 | 90 | 850 | 0.129 | 120 | 0.29 | 3 | 1 |
| 8 | 0.95 | 1000 | 35 | 650 | 0.132 | 240 | 0.15 | 2 | 1 |
| 9 | 1.22 | 950 | 45 | 750 | 0.138 | 1200 | 5.56 | 3 | 5 |
| 10 | 0.95 | 1200 | 80 | 820 | 0.129 | 240 | 8.20 | 2 | 5 |
| 11 | 1.20 | 1000 | 45 | 950 | 0.131 | 680 | 13.9 | 1 | 5 |

Grade of streak: (good) ← 54321 → (bad)
Grade of mottling: (good) ← 54321 → (bad)

Figure 3:
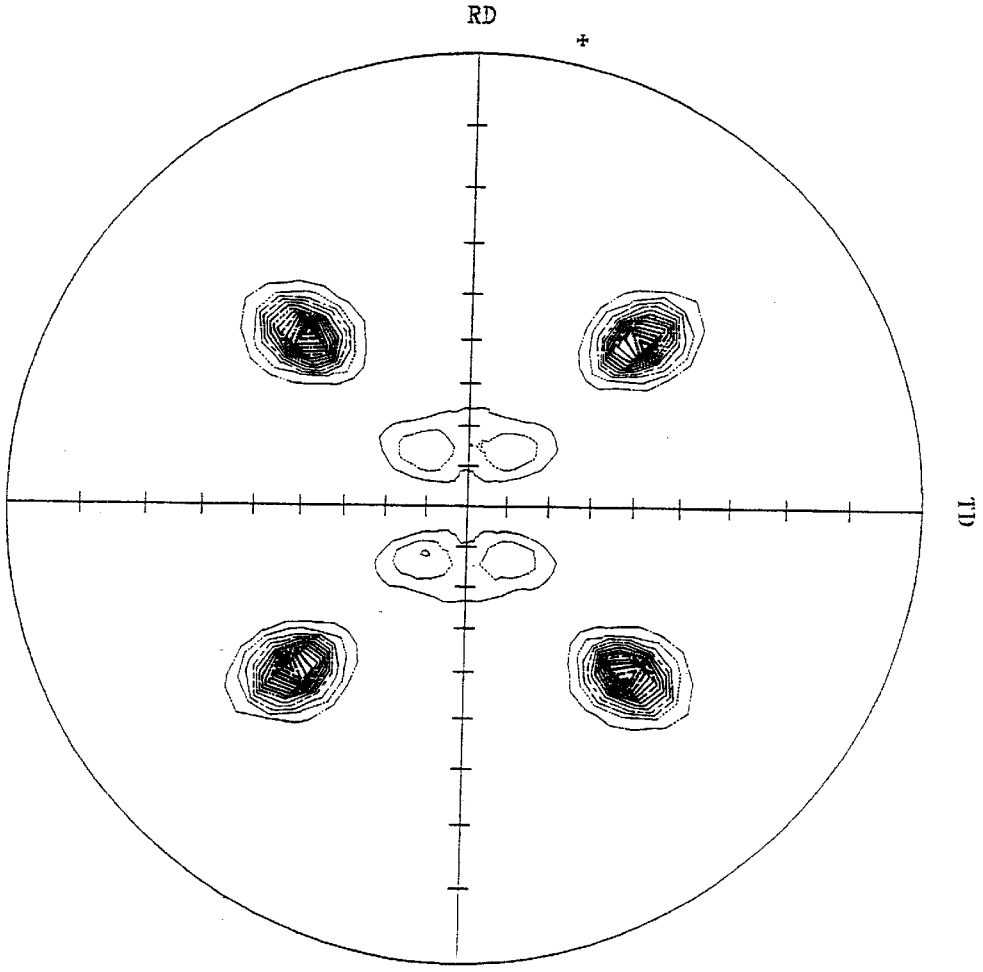
FIG. 3 is a (111) pole figure of an Invention Material 3.
Figure 4:
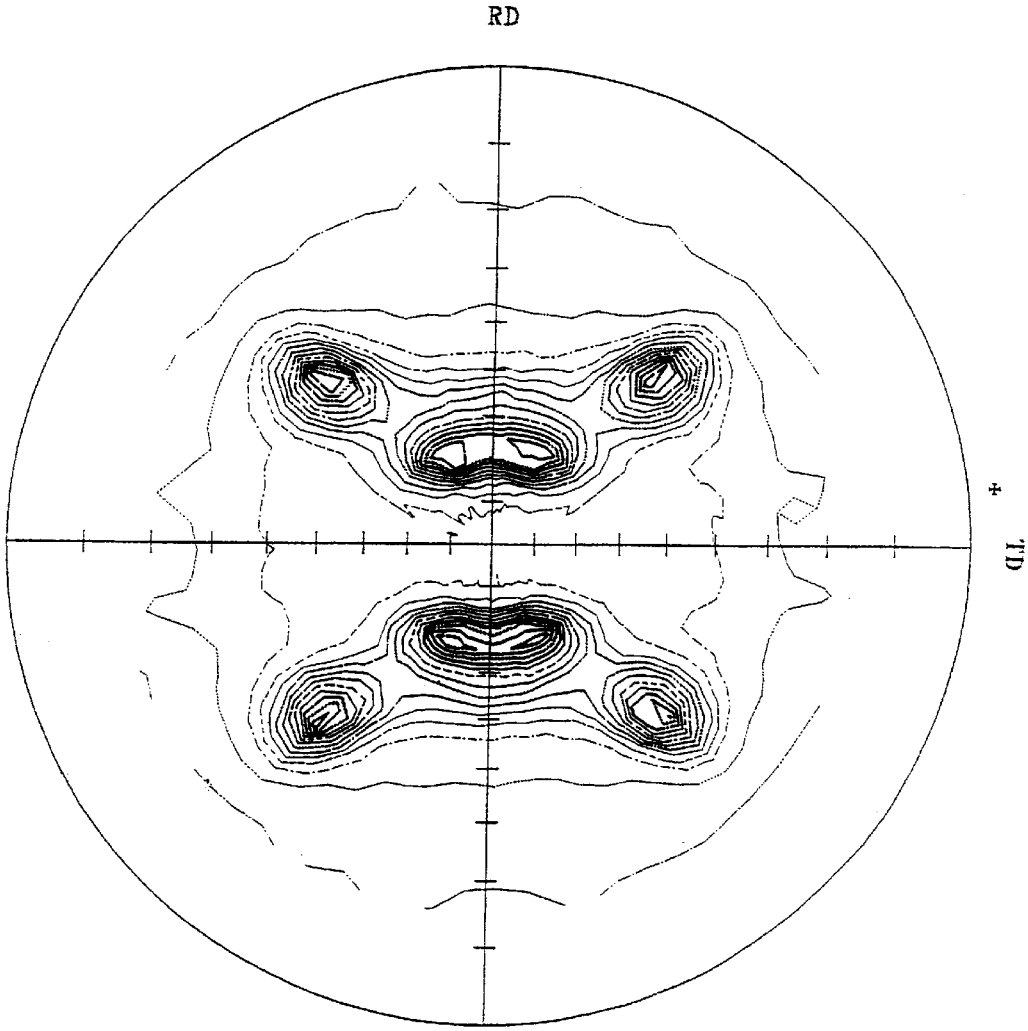
FIG. 4 is a (111) pole figure of an Invention Material 1.
Figure 5:
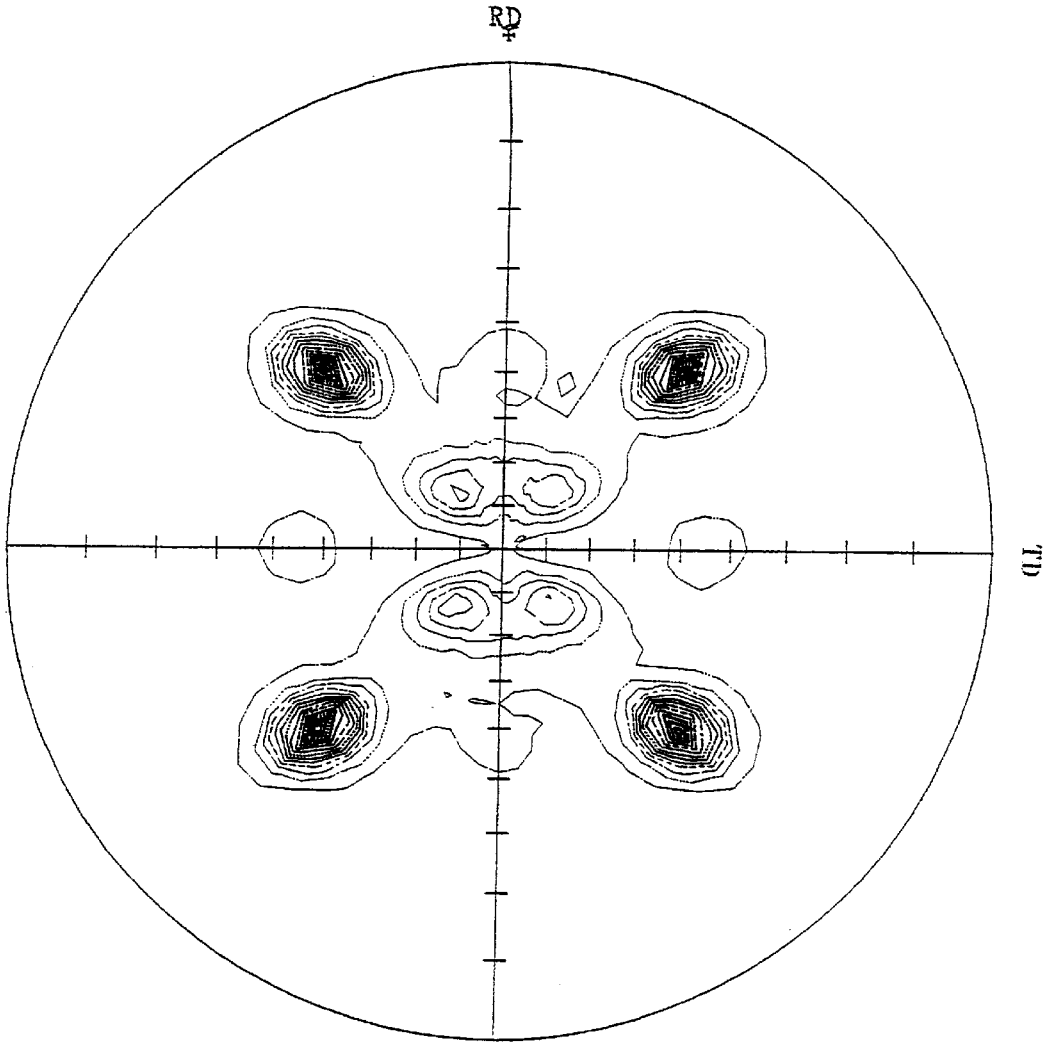
FIG. 5 is a (111) pole figure of an Invention Material 4.

And also, FIGS. 3, 4 and 5 show the pole figures of the invention materials Nos. 3, 1, 4 in Table 3, respectively, which are pole figures of the materials suitable for the invention. Among them, FIGS. 3 and 4 show Ir=4.66 and Ir=0.93 as upper limit and lower limit of the invention, respectively, and FIG. 5 shows Ir=2.79 as an optimum condition of the invention.

Figure 6:
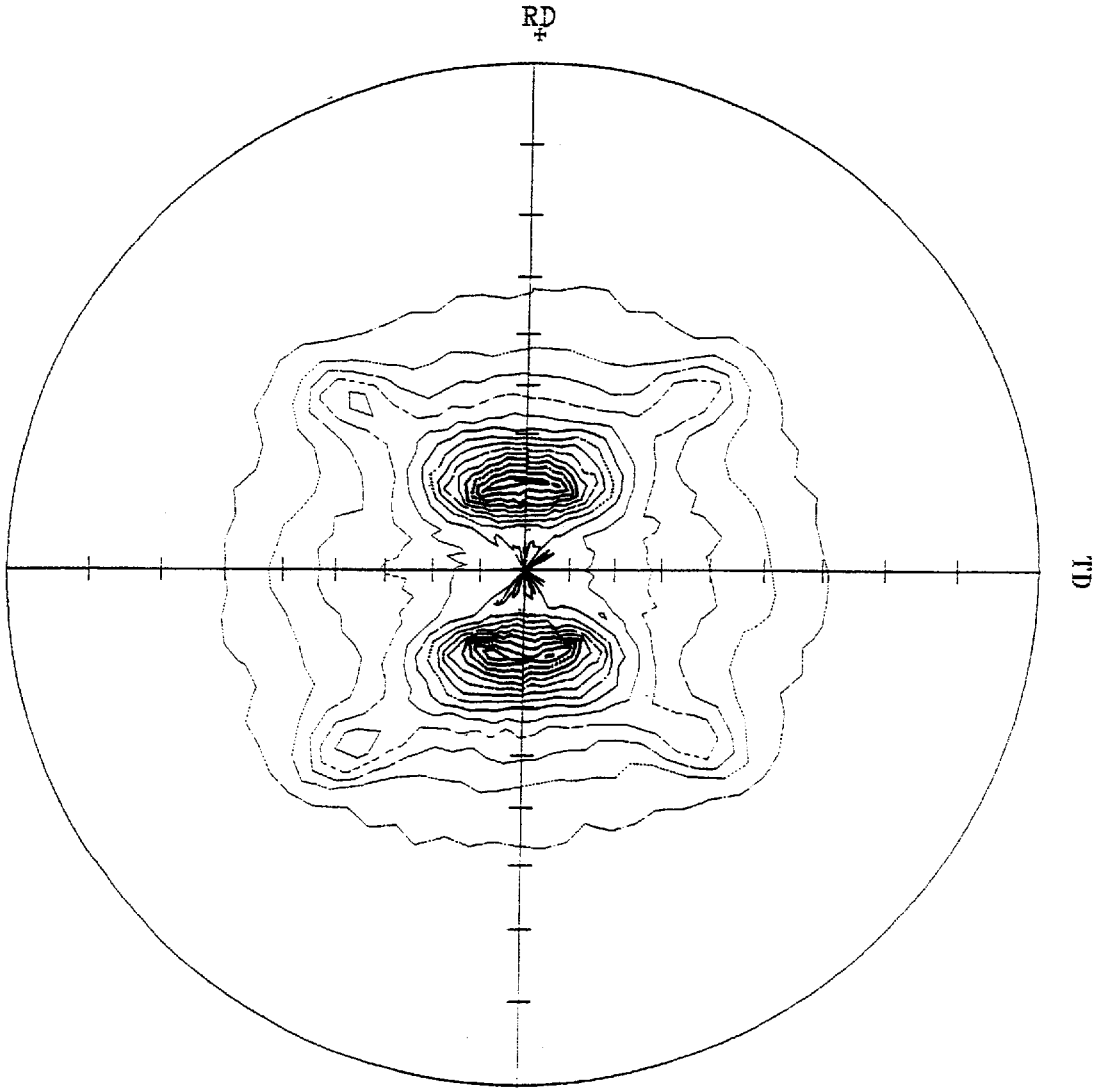
FIG. 6 is a (111) pole figure of a Comparative Material 6.

On the other hand, FIG. 6 shows the pole figure of the comparative material No. 6, wherein (100)<001> cubic temperature of 900–1150° C. When the temperature is low (<900° C.), the crystal of cubic orientation in the finish product excessively grows and hence the ratio of crystal having the twinning orientation of (221)<212> becomes lower and the streak grade lowers. Moreover, the reason why the streak grade is degraded as the ratio of the crystal having the twinning orientation becomes smaller is considered due to the fact that the coherency of preferential orientation <001> in the rolling direction at individual crystal grain unit is delicately disordered by the accumulation of crystals having the cubic orientation, which is seen in streak form. Inversely, when the temperature of the middle annealing is higher (>1150° C.), the growth of the crystals having the cubic orientation becomes poor and the etching rate lowers and the coherency of individual etching holes in the pattern etching of the shadow mask lowers to generate the whole streak called as the mottling.

And also, the soaking time in the middle annealing is preferably within a range of 5–60 seconds. When the time is less than 5 seconds, the recovery of the recrystallization is insufficient and the structure of the mixed grains is held to lower the etching quality. While, when the time exceeds 60 seconds, the coarse grains are formed and the growth of crystal having the cubic orientation lowers to form the mixed grain structure and hence lower the etching quality.

In the invention, it is favorable to regulate the finish annealing conditions after the secondary cold rolling and before the etching in addition to the above middle annealing. That is, the finish annealing is carried out for finely and uniformly aligning the crystal grains in the product and preventing the roughness of the hole wall face after the etching, which causes the mottling, and is effective to be treated at an annealing temperature of 700–900° C. for a soaking time of 60–600 seconds. When the annealing temperature in the finish annealing is lower than 700° C., the recrystallization is insufficient, while when it is higher than 900° C., the coarsening is caused to lower the etching quality.

Moreover, the soaking time for such an annealing is favorable to be within a range of 60–600 seconds in accordance with the growth of the individual crystal grains and the degree of developing the crystal orientation. For example, as the soaking time becomes shorter (<60 seconds), the growth of the crystal having the cubic orientation is insufficient and the etching rate lowers and the mottling occurs. On the other hand, when the soaking time is long (>600 seconds), the crystal grains are coarsened and the twinning orientation is excessively developed rather than the cubic orientation and the streak grade lowers.

These annealing conditions have an adequate range, which is favorable to be a zone surrounded by a, b, c, d in FIG. 1.

In addition to the above "streak" depending upon the crystal orientation, "streak" resulted from the component segregation of Ni, Mn or the like is examined in the invention. As a result, the streak produced due to the component segregation is seen in a strip form through a transparent light as the degree becomes strong when being observed in a shadow mask product, but is frequently observed in a slanting light from small hole side. It can be guessed that light transmitted from the big hole to the small hole is subjected to scattering or diffraction to emphasize and observe the etching face resulted in the streak at the big hole side.

That is, when the main cause of generating the streak is the segregation, if the segregation is distributed in the thickness direction, it is considered that the strength of the distributed segregation and the distribution width govern the strength and form of the streak. Now, the segregation in the thickness direction is represented by a strength of the segregation ((maximum segregation amount of a line analysis through EPMA) and an average thereof (standard deviation in full thickness).

Here, the maximum segregation amount of the line analysis (segregation) in a width corresponding to the thickness is defined by Cmax, and the average segregation amount in the thickness direction (standard deviation) is defined by Cs. A relatively thick streak is mitigated by using these values based on Ni and rendering values of Si, Mn and P into given ranges. The measuring conditions through the line analysis of EPMA are concretely shown in Table 4.

Figure 8:
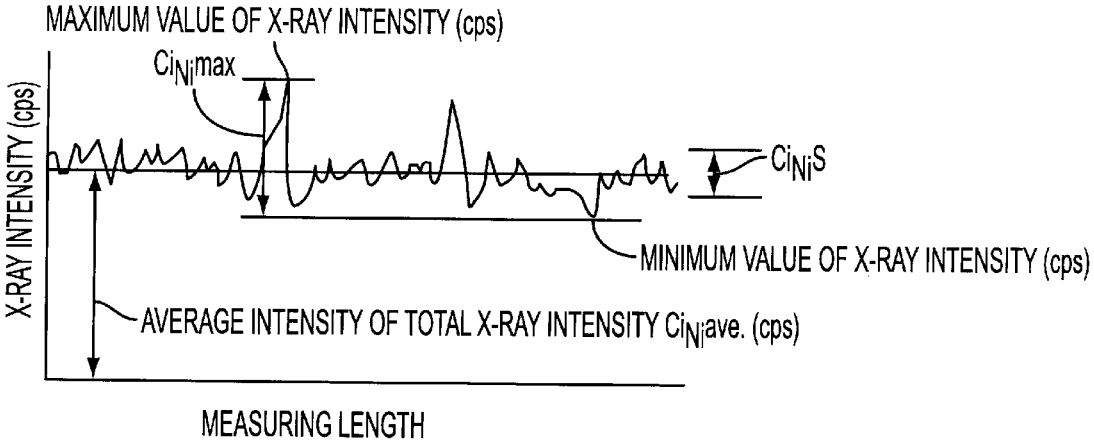
FIG. 8 is a diagrammatic view illustrating a definition of segregation amounts of components on a section of a plate.

Moreover, the definitions of Cmax and Cs are described based on FIG. 8 below. Definition of component segregation amount at plate section After the plate section of the product is polished, the line analysis is carried out in the plate direction of the product through an X-ray microanalyzer.

The measuring conditions are the same as shown in Table 1, and the measuring length is the plate thickness of the material. The segregation amount is calculated according to the following equation based on X-ray intensity (c.p.s.) of the measured line analysis.

① Segregation amount $C_{Ni}s(\%)$=analytical value of Ni component×$Ci_{Ni}s$ (c.p.s.)×$Ci_{Ni}ave.$ (c.p.s.)

② Maximum segregation amount $C_{Ni}max(\%)$=analytical value of Ni component (%)×$Ci_{Ni}max/Ci_{Ni}ave.$ $Ci_{Ni}s$: standard deviation of X-ray intensity (c.p.s.)

$Ci_{Ni}ave.$: average intensity of total X-ray intensities (c.p.s.)

$Ci_{Ni}max$: maximum X-ray intensity (c.p.s.) (=maximum value−minimum value in X-ray intensity)

$Ci_{Ni}ave.$: average intensity of total X-ray intensities (c.p.s.)

Analytical value of Ni component (%) is Ni content included in the material and a value analyzed by chemical process or the like.

Although the above is described with respect to Ni, the similar definition is applied to Si, Mn and P.

TABLE 4

| | |
|---|---|
| Probe diameter | 1 μm |
| Irradiated current | $5.0 \times 10^{-7}$ A |
| Accelerated voltage | 20 kV |
| Measuring time | 0.5 sec/point |
| Measuring interval | 2 μm |
| Analyzing crystal | LIF (Ni, Mn), TAP (Si), PET (P) |

Now, the inventors examined the segregation degree of each component with respect to materials (No. 21–No. 37) produced from the alloy shown in Table 2 under conditions shown in Table 5. The results are shown in Table 6. As seen from the results of Table 6, it is effective to control the segregation amount of each of Ni, Si, Mn and P to the following segregation amount for obtaining materials being excellent in the streak and mottling.

Figure 9:
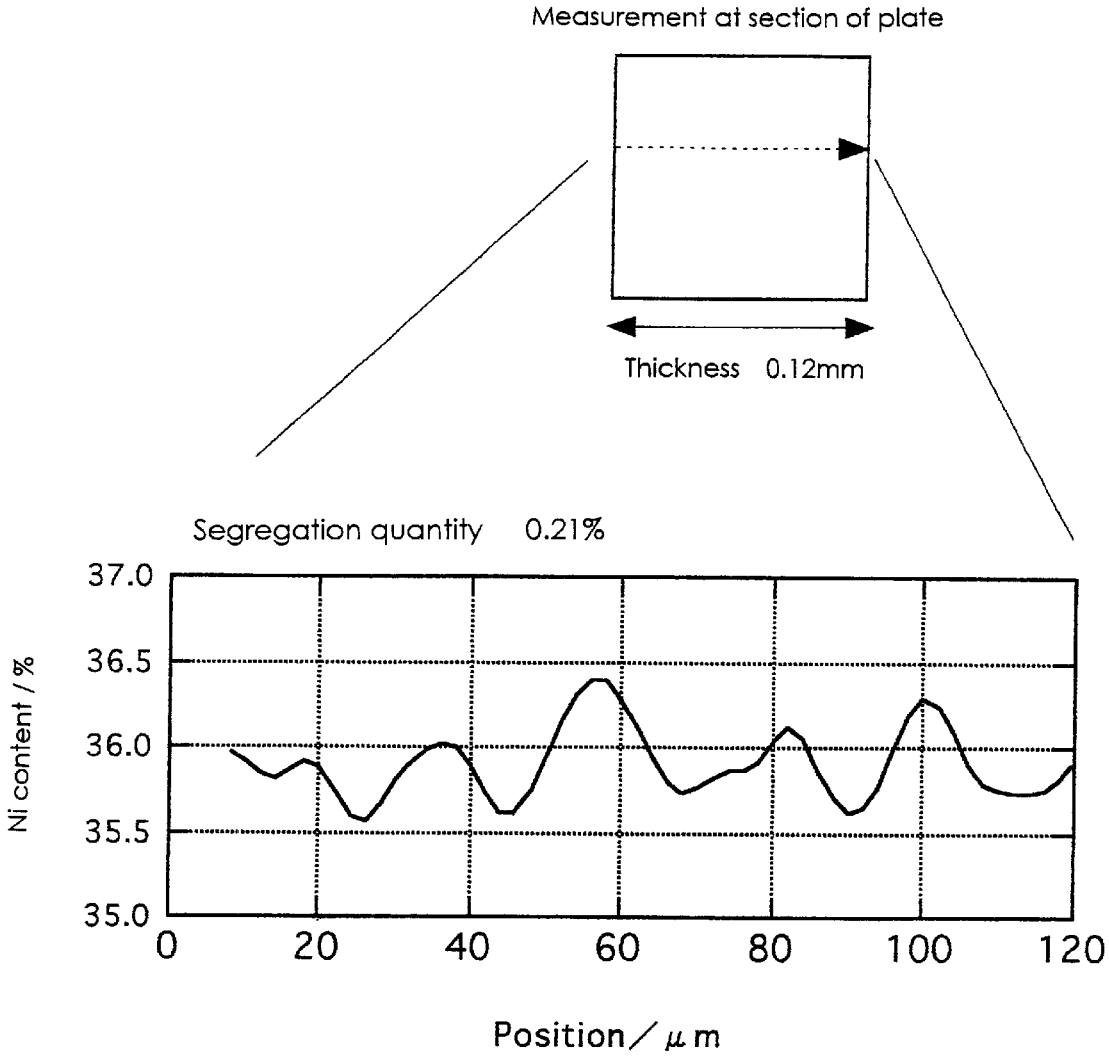
FIG. 9 is a schematic view illustrating a measuring example of Ni segregation amount through an X-ray microanalyzer.

As to the measurement of component segregation, an example of measuring Ni segregation is shown in FIG. 9.

1. Segregation of Ni component in the thickness direction.

① The segregation amount $C_{Ni}s$ is not more than 0.30%, preferably not more than 0.20%, more particularly not more than 0.10%.

② The maximum segregation amount $C_{Ni}max$ is not more than 1.5%, preferably not more than 1.0%, more particularly not more than 0.5%.

Because, Ni is an essential component and the segregation of Ni is apt to cause the streak.

2. The segregation of Si component in the thickness direction is a cause of the streak likewise Ni and is favorable to control to the following numerical values.

① The segregation amount $C_{Si}s$ is not more than 0.002%, preferably not more than 0.015%, more particularly not more than 0.001%.

② The maximum segregation amount $C_{Si}max$ is not more than 0.01%, preferably not more than 0.07%, more particularly not more than 0.05%.

3. The segregation of Mn component in the thickness direction is a cause of the streak likewise Ni, Si and is favorable to control to the following numerical values.

① The segregation amount $C_{Mn}s$ is not more than 0.010%, preferably not more than 0.008%, more particularly not more than 0.005%.

② The maximum segregation amount $C_{Mn}max$ is not more than 0.05%, preferably not more than 0.025%, more particularly not more than 0.020%.

4. The segregation of P component in the thickness direction is a cause of the streak likewise Ni, Si, Mn and is favorable to control to the following numerical values.

① The segregation amount $C_Ps$ is not more than 0.001%, preferably not more than 0.0007%, more particularly not more than 0.0005%.

② The maximum segregation amount $C_Pmax$ is not more than 0.005%, preferably not more than 0.003%, more particularly not more than 0.002%.

In order to prevent the component segregation such as Ni segregation and the like, it is effective to subject a slab after casting or forging to a homogenizing heat treatment. For example, it is possible to subject the cast slab to a heat treatment at a temperature of not lower than 1250° C. for not less than 40 hr.

TABLE 5

| Run No. | Soaking conditions of slab (° C.) (hr) | Thickness (mm) | Middle annealing temperature (° C.) | Soaking time of middle annealing (s) | Finish annealing temperature (° C.) | Soaking time of finish annealing (s) | Finish thickness (mm) |
|---|---|---|---|---|---|---|---|
| 21 | 1300 × 45 | 1.20 | 950 | 25 | 750 | 120 | 0.132 |
| 22 | 1320 × 62 | 1.00 | 1050 | 40 | 850 | 200 | 0.133 |
| 23 | 1290 × 50 | 0.98 | 1025 | 35 | 780 | 350 | 0.135 |
| 24 | 1340 × 55 | 1.15 | 1070 | 15 | 800 | 180 | 0.125 |
| 25 | 1350 × 65 | 1.25 | 925 | 50 | 820 | 90 | 0.140 |
| 26 | 1280 × 45 | 1.23 | 1250 | 45 | 800 | 78 | 0.128 |
| 27 | 1300 × 45 | 1.05 | 1050 | 90 | 850 | 120 | 0.129 |
| 28 | 1350 × 70 | 0.95 | 1000 | 35 | 650 | 240 | 0.132 |
| 29 | 1360 × 42 | 1.22 | 950 | 45 | 750 | 1200 | 0.138 |
| 30 | 1350 × 15 | 1.00 | 945 | 60 | 750 | 200 | 0.140 |
| 31 | 1240 × 95 | 1.20 | 1000 | 45 | 800 | 300 | 0.128 |
| 32 | 1300 × 25 | 1.05 | 900 | 35 | 750 | 250 | 0.125 |
| 33 | 1290 × 30 | 1.20 | 1050 | 50 | 800 | 400 | 0.127 |
| 34 | 1370 × 8 | 0.85 | 1000 | 30 | 750 | 120 | 0.130 |
| 35 | 900 × 5 | 0.90 | 1025 | 45 | 800 | 360 | 0.129 |
| 36 | 1100 × 15 | 0.95 | 1200 | 80 | 820 | 240 | 0.129 |
| 37 | 1050 × 7 | 1.20 | 1000 | 45 | 950 | 680 | 0.131 |

TABLE 6

| Run No. | Intensity ratio Ir (100)<001>/(221)<212> | Ni segregation maximum segregation amount (Cmax/%) | Ni segregation average segregation amount (Cs/%) | Si segregation maximum segregation amount (Cmax/%) | Si segregation average segregation amount (Cs/%) | Mn segregation maximum segregation amount (Cmax/%) |
|---|---|---|---|---|---|---|
| Invention example 21 | 0.93 | 0.75 | 0.22 | 0.0080 | 0.0015 | 0.030 |
| Invention example 22 | 1.27 | 0.55 | 0.15 | 0.0070 | 0.0012 | 0.023 |
| Invention example 23 | 4.66 | 0.90 | 0.20 | 0.0040 | 0.0009 | 0.035 |
| Invention example 24 | 2.79 | 0.45 | 0.18 | 0.0055 | 0.0015 | 0.040 |
| Invention example 25 | 1.75 | 0.35 | 0.08 | 0.0045 | 0.0008 | 0.022 |
| Comparative example 26 | 0.36 | 0.80 | 0.17 | 0.0070 | 0.0010 | 0.030 |
| Comparative example 27 | 0.29 | 1.20 | 0.25 | 0.0095 | 0.0018 | 0.045 |
| Comparative example 28 | 0.15 | 0.30 | 0.07 | 0.0030 | 0.0012 | 0.016 |
| Comparative example 29 | 5.56 | 0.55 | 0.09 | 0.0065 | 0.0010 | 0.020 |
| Comparative example 30 | 1.5 | 1.75 | 0.25 | 0.0075 | 0.0019 | 0.022 |
| Comparative example 31 | 2.4 | 0.98 | 0.42 | 0.0075 | 0.0090 | 0.005 |
| Invention example 32 | 1.9 | 1.20 | 0.28 | 0.0125 | 0.0025 | 0.004 |
| Invention example 33 | 2.3 | 1.15 | 0.25 | 0.0095 | 0.0018 | 0.055 |
| Invention example 34 | 2.5 | 0.95 | 0.22 | 0.0070 | 0.0018 | 0.040 |

TABLE 6-continued

| | | | | | | |
|---|---|---|---|---|---|---|
| Comparative example 35 | 2.75 | 2.40 | 0.58 | 0.0155 | 0.0032 | 0.075 |
| Comparative example 36 | 0.45 | 1.70 | 0.35 | 0.0105 | 0.0025 | 0.050 |
| Comparative example 37 | 13.9 | 1.56 | 0.45 | 0.0120 | 0.0022 | 0.065 |

| Run No. | Mn segregation average segregation amount (Cs/%) | P segregation maximum segregation amount (Cmax/%) | P segregation average segregation amount (Cs/%) | Grade of streak | Grade of mottling |
|---|---|---|---|---|---|
| Invention example 21 | 0.0080 | 0.0040 | 0.0007 | 5 | 4 |
| Invention example 22 | 0.0052 | 0.0032 | 0.0006 | 5 | 4 |
| Invention example 23 | 0.0050 | 0.0025 | 0.0004 | 5 | 5 |
| Invention example 24 | 0.0065 | 0.0035 | 0.0008 | 5 | 5 |
| Invention example 25 | 0.0045 | 0.0028 | 0.0005 | 5 | 5 |
| Comparative example 26 | 0.0075 | 0.0042 | 0.0007 | 4Δ | 2 |
| Comparative example 27 | 0.0088 | 0.0037 | 0.0005 | 3Δ | 1 |
| Comparative example 28 | 0.0035 | 0.0022 | 0.0004 | 2Δ | 1 |
| Comparative example 29 | 0.0065 | 0.0030 | 0.0006 | 3Δ | 5 |
| Comparative example 30 | 0.0420 | 0.0030 | 0.0008 | 2X | 4 |
| Comparative example 31 | 0.0085 | 0.0038 | 0.0008 | 2X | 5 |
| Invention example 32 | 0.0090 | 0.0045 | 0.0009 | 4Δ | 4 |
| Invention example 33 | 0.0120 | 0.0040 | 0.0007 | 4Δ | 4 |
| Invention example 34 | 0.0070 | 0.0075 | 0.0018 | 4Δ | 5 |
| Comparative example 35 | 0.0180 | 0.0065 | 0.0025 | 1X | 4 |
| Comparative example 36 | 0.0120 | 0.0055 | 0.0025 | 2XΔ | 2 |
| Comparative example 37 | 0.0150 | 0.0050 | 0.0020 | 1XΔ | 5 |

Grades of streak and mottling are acceptable above 4.
X: The presence of relatively large and ununiform streak resulted from segregation is observed, and the use is impossible.
○: Streak resulted from segregation is somewhat observed, but the use is possible.
Δ: Streak resulted from rising texture is observed.

Moreover, the feature that the segregation such as Ni segregation or the like causes the streak is disclosed in JP-A-1-252725, JP-A-2-117703, JP-A-9-143625 and so on. However, these conventional techniques define only the production conditions, or the segregation amount at arbitrary position, or only the maximum segregation amount in the thickness direction. However, they do not notice and mention both the average segregation amount and maximum segregation amount in the thickness direction as defined in the invention. That is, the streak resulted from the segregation can not be solved even by controlling only the maximum segregation amount (Cmax), and further it is also required to conduct the control of the average segregation amount in the section direction (standard deviation value Cs).

In the invention, the adoption of the following method is effective to prevent the occurrence of the above streak defect produced in the etching of Fe—Ni alloy or the like and provide a shadow mask material having good etching properties.

For example, an alloy comprising 34–38 wt % of Ni and the remainder being substantially Fe is refined and cast or forged to form a slab, which is subjected to a homogenizing heat treatment within a temperature range of 1250–1400° C. for not less than 40 hr and then hot rolled to obtain a hot band of about several mm in thickness. The homogenizing treatment of the slab is effective for mitigating the segregation in the plate section and solving the streak resulted from the segregation. The thus obtained hot band is subjected to a recrystallization annealing, pickling or the like, if necessary, and subjected to a middle (primary) cold rolling and then to a middle annealing before the finish (secondary) cold rolling. Moreover, the middle annealing is carried out for controlling the growth of cubic orientation (100)<001> and conducted at a temperature of 900–1150° C. as mentioned above. In addition to the middle annealing, the finish annealing before finish (secondary) cold rolling is further carried out, but the conditions for this annealing are as mentioned above.

In the material according to the invention, the section cleanness defined according to JIS G0555 is made not more than 0.05%, preferably not more than 0.03%, more particularly not more than 0.02%, most preferably not more than 0.017% in order to more suppress the streak in addition to the control of the texture represented by the X-ray intensity ratio IR and the control of the segregation of Ni, Mn or the like. When the section cleanness exceeds the above numerical value, the etching accuracy lowers and the rejection ratio of the product becomes degraded.

Figure 10:
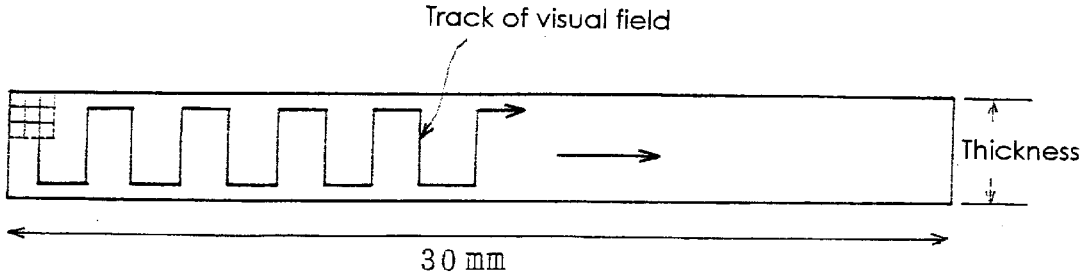
FIG. 10 is a schematic view illustrating a method of measuring a section cleanness of an alloy plate.

Moreover, the measurement of the above section cleanness is carried out according to JIS G0555. Concretely, The product is cut into a length of 30 mm in the rolling direction, and the cut face is polished to form a grid having 20 lattice lines in length and breadth, and the grid is placed in a microscope to observe 60 visual fields at a magnification of 400 while moving the visual field zigzag as shown in FIG. 10. Therefore, the measuring face is a section in parallel to the rolling direction, and the measuring area is a plate thickness×30 mm. The section cleanness d is determined by the following equation:

$$d(\%)=(n/P\times f)\times 100$$

wherein P is number of lattice points, f is number of visual fields and n is number of total lattice centers in f-visual fields.

Furthermore, it is preferable to properly control a roughness of a surface of the material according to the invention such as Ra, Rsk, Sm and Rθa.

① Firstly, a center-line average roughness Ra in the surface roughness of the product is a parameter showing an average size of roughness. As the value becomes too large, the scattering in the light exposure becomes strong and also the difference in the start time for the formation of hole in the etching is caused to degrade the hole shape. Inversely, when the value is too small, evacuation is not sufficiently conducted in the vacuum suction and the poor adhesion between the pattern and the material is easily caused.

In the invention, it is $0.2 \leqq Ra \leqq 0.9$. The preferable lower limit of the center-line average roughness Ra is not less than 0.25 μm, more preferably not less than 0.3 μm, particularly not less than 0.35 μm. On the other hand, the upper limit is not more than 0.85 μm, preferably not more than 0.8 μs, more particularly not more than 0.7 μm.

② Next, Rsk showing a relativity of surface roughness is a parameter straightforward indicating convex or concave pattern and the symmetry with respect to a center line of a distribution in an amplitude distribution curve (ADF) is represented by a numerical value according to the following equation.

$$Rsk=1/\sigma^3\int Z^3P(z)dz$$

wherein σ is a square average value and $\int Z^3P(z)dz$ is a third moment of the amplitude distribution curve.

As the value of Rsk becomes larger, the scattering in the light exposure is strong and the hole shape is degraded. Inversely, when it is positive and too large, the evacuation in the vacuum suction is nit sufficiently conducted and the poor adhesion between the pattern and the material is easily caused.

In the invention, therefore, it is $-0.5 \leqq Rsk \leqq 1.3$. The preferable lower limit is not less than 0, more particularly not more than 0.1. On the other hand, the upper limit is preferably not more than 1.1, more particularly not more than 1.0.

③ Then, the average mountain interval represented by Sm is indicates a magnification of a pitch between mountain and valley in the roughness. Such a roughness is said to straightforward show poor vacuum suction partially produced when the unevenness is too large, or poor hole shape due to the strong scattering in the light exposure produced when it is too small.

In the invention, Sm is $20\ \mu m \leqq Sm \leqq 250\ \mu m$.

The preferable lower limit of Sm is not less than 40 μm, more preferably not less than 50 μm, particularly not less than 80 μm. On the other hand, the preferable upper limit is not more than 200 μm, more preferably not more than 160 μm, particularly not more than 150 μm, and the optimum example is not more than 130 μm.

④ Finally, square average gradient represented by Rθa shows an average inclination degree of the roughness. The larger the numerical value of this parameter, the larger the steepness of the unevenness in the roughness. This value can be determined by the following equation:

$$R\theta a=1/L^i{}_0\int d/dx.f(x)|dx$$

wherein L is a measuring length and f(x) is a section curve of the roughness).

As the value becomes larger, the scattering in the light exposure becomes strong and the poor hole shape is easily caused, while when it is too small, the poor adhesion between the pattern and the material is apt to easily be caused in the vacuum suction.

In the invention, Rθa is a range of $0.01 \leqq R\theta a \leqq 0.09$. The preferable lower limit of Rθa is not less than 0.015, more preferably not less than 0.020, particularly not less than 0.025. On the other hand, the preferable upper limit is not more than 0.07, more preferably not more than 0.06, particularly not more than 0.05, and an optimum example is not more than 0.04.

The adjustment to the above surface roughness can easily be attained by using dull rolls in the cold rolling of the material for shadow mask to a finish size. Such dull rolls are rolls having an irregularity on their surfaces. When the material for shadow mask is rolled by using such rolls, the above irregularity is transferred onto the surface of the material in form of a reversed pattern. The irregularity of the dull roll is worked by a discharge working, laser working, shot blast process, or the like. For example, steel grid of #120 may be used as a roll working condition in the shot blast process.

In the material according to the invention, it is favorable to control the number of inclusions in addition to the above characteristics. That is, the number of inclusions having a size of not less than 10 μm to be measured is controlled to not more than 65 per unit area of 100 $mm^2$ by polishing the plate from the surface to an arbitrary depth. In this case, the number of inclusion is desirable to be preferably not more than 40, more preferably not more than 30, particularly not more than 25, most preferably not more than 20. The reason why the number is limited to the above value is due to the fact that the inclusions in the material is as smaller as possible because the shadow mask is generally required to take a fine etching technique.

Moreover, the inclusion number and the section cleanness are similar concepts, but the area of the foreign matter is defined by only the section cleanness d, and it is effective to restrict the size of the inclusion on the surface portion of the plate for further reducing the rejection ratio.

The measurement of the above inclusion number is carried out by polishing the surface of the plate, and finally buffing the surface, and observing the face parallel to the plate surface to measure the number of inclusions. In the measurement, an area of 10 mm×10 mm is observed. In FIG. 11 is shown a photograph of large inclusion resulting in the rejection.

In the invention, it is also effective to control the number of inclusions having a size of not less than 10 pa measured in the plate section to not more than 80 per unit area of 100 $mm^2$ in addition to the control of the inclusion number at the plate surface. The number is preferably not more than 70, more preferably not more than 50, further preferably not more than 40, particularly not more than 30, and an optimum example is not more than 20. Because, the rejection ratio can not be rendered into 0 by controlling only the section cleanness d, so that the rejection ratio can be further decreased by restricting the size of the inclusion.

Figure 12:
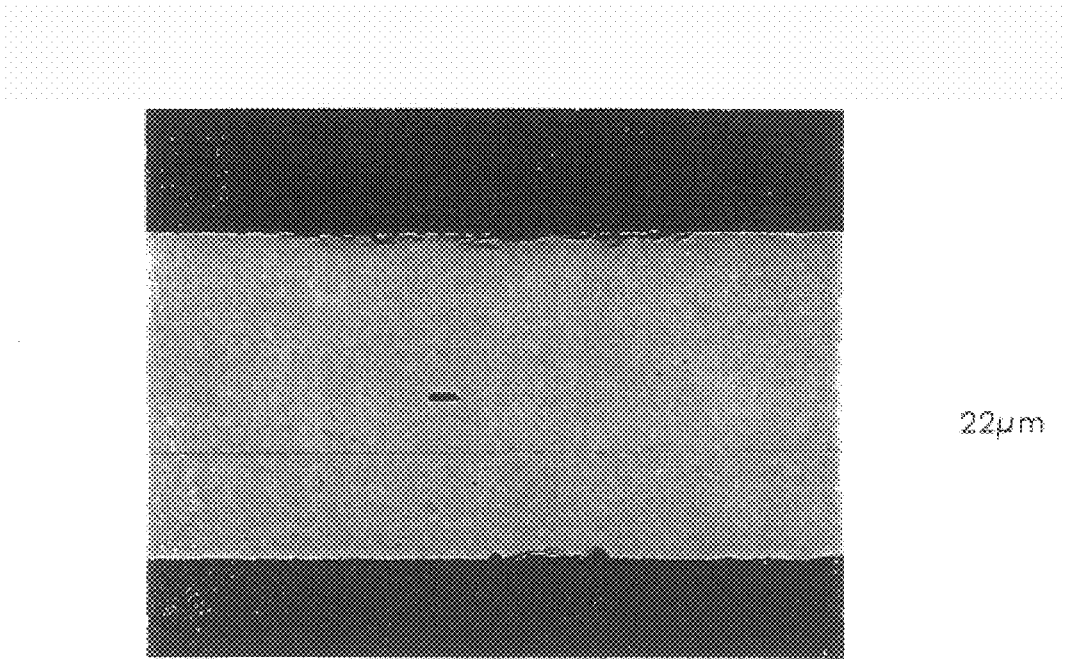
FIG. 12 is a microphotograph showing an example of large size inclusions on a surface of an alloy plate.

Moreover, the measurement of the inclusion number at the plate section is carried out by polishing a section parallel to the rolling direction, finishing through buffing and observing by means of a microscope. About 3 sections of plate thickness×25 mm in length are measured and the measured value is converted into 100 $mm^2$. In FIG. 12 is shown a photograph of large inclusion resulted in the rejection.

In the invention, it is possible to control the above cleanness and inclusion number by floating and separating inclusions in a ladle at a refining step.

In the invention, it is favorable to render the crystal grain size in the alloy into a grain size indicating a size of not less than 7.0 as a grain size number measured according to a method of JIS G0551 (control more finely). It is preferably not less than 8.0, more preferably not less than 8.5, further preferably not less than 9.5.

The reason on the limitation of the crystal grain size in the alloy is due to the fact that when the crystal grains are large (grain size number of not more than 7.0), streak of transmitted light and hence phenomenon called as mottling is caused by scattering and irregular etched holes resulted from the difference of the etching rate in accordance with the crystal orientation. And also, poor hole is formed and the yield is lowered. Furthermore, inconvenience is caused in the press working.

The measurement of the crystal grain size is carried out by rendering the plate section in a direction perpendicular to the rolling direction into a mirror face and buffing and thereafter etching with an aqua regia and comparing with a diagram of austenite structure standard crystal grain size described in JIS G0551 at an observation magnification of 200 times to determine a grain size number. Moreover, the diagram of the standard crystal grain size is standardized by the observation magnification of 100 times, so that correction is +2.0 with respect to the grain size number of the standard diagram. (the grain size number is measured every 0.5.)

EXAMPLES

Example 1

A steel ingot of Fe—Ni based alloy suitable for the invention having the composition shown in Table 2 is melted by a vacuum degassing process and thereafter hot rolled to obtain a hot rolled plate of 5 mm, which is repeatedly subjected to cold rolling and annealing under conditions shown in Table 3 to obtain a material having a thickness of 0.13t. Then, the material is rendered into an actual shadow mask product through a photoetching process and various evaluations are made. The etching is carried out by using a mask pattern of 0.26 mm in pitch with a 46 Baum. solution of ferric chloride at a temperature of 50° C. under a spraying pressure of 2.5 $kgf/cm^2$.

In Table 3, sample Nos. 1–5 are production examples according to the invention, and sample Nos. 6–11 are comparative examples. Moreover, when the characteristics after the etching are evaluated with respect to the thus obtained shadow mask products, all materials according to the invention are good in the matching property to the mold and tensile rigidity in the press forming and a black oxide film having a good adhesion property in the blackening and sufficient radiation property is confirmed to be produced, which indicate excellent characteristics as a shadow mask product.

Example 2

In this example, the combination of various factors is examined in order to more improve the yield and the like though shadow mask materials capable of sufficiently satisfying the quality and product yield as compared with those of the conventional shadow mask material are provided when the X-ray intensity ratio and section cleanness are within adequate ranges. The results are shown in Table 7.

Table 7 shows a relationship among the section cleanness, surface roughness (Ra, Rsk, Sm), number of inclusions having a size of not less than 10 μm at plane and section, grain size number, presence or absence of baking in the annealing before the pressing and hole rejection ratio. As a surface roughness meter is used a SURFCOM 1500A made by Tokyo Seimitsu Co., Ltd. As a result, the following facts are confirmed.

① When the section cleanness exceeds 0.05%, the hole rejection ratio becomes somewhat higher (No. 44).

② When the number of inclusions having a size of not less than 10 μm observed at the plane and section exceeds 65 and 80, respectively, per unit area, it is confirmed to somewhat increase the occurrence of poor holes (No. 50, 51).

③ As the grain size number is not more than 7.0, the hole rejection ratio somewhat increases, because individual crystal grains are large and have an opening shape dependent upon each crystal orientation and it is relatively difficult to form uniform holes (No. 52).

④ As mentioned above, the adequate surface roughness enhances the resist application before the etching, and adhesion property of the resist at the light exposure step and improves the vacuum suction and plays a role for preventing halation through the light exposure, and prevents the adhesion between shadow masks in the annealing before the pressing and hence prevents the streak of the black (oxide) film through the adhesion. In order to prove these facts, it is confirmed that the blackened streak is caused due to the hole rejection ratio resulted from the etching or the baking (adhesion between the plates in the annealing before the pressing) in accordance with the combination of Ra, Rsk and Sm (No. 45, 46, 47, 48, 49).

TABLE 7

| | Section cleanness (%) | X-ray intensity ratio (100)<001>/(221)<212> | Ra μm | Rsk | Sm μm | Number of inclusions on surface/100 $mm^2$ | Number of inclusions at section/100 $mm^2$ | Grain size number | Hole rejection ratio (%) | Rejection ratio due to baking in annealing before pressing |
|---|---|---|---|---|---|---|---|---|---|---|
| Invention examples | | | | | | | | | | |
| 41 | 0.008 | 1.2 | 0.55 | 0.5 | 105 | 7 | 10 | 10.5 | 0.00 | 0.00 |
| 42 | 0.017 | 1.0 | 0.43 | 0.1 | 55 | 15 | 42 | 10.0 | 0.03 | 0.00 |
| 43 | 0.030 | 0.9 | 0.73 | 0.9 | 156 | 30 | 59 | 10.5 | 0.02 | 0.00 |
| Reference | | | | | | | | | | |

TABLE 7-continued

| | Section cleanness (%) | X-ray intensity ratio (100)<001>/(221)<212> | Ra μm | Rsk | Sm μm | Number of inclusions on surface/100 mm² | Number of inclusions at section/100 mm² | Grain size number | Hole rejection ratio (%) | Rejection ratio due to baking in annealing before pressing |
|---|---|---|---|---|---|---|---|---|---|---|
| examples | | | | | | | | | | |
| 44 | *0.06 | 1.3 | 0.45 | −0.2 | 65 | 25 | 25 | 9.0 | 0.15 | 0.00 |
| 45 | 0.025 | 0.8 | *1.0 | 0.5 | 102 | 30 | 28 | 9.5 | 0.26 | 0.50 |
| 46 | 0.015 | 1.0 | 0.55 | *−0.8 | 115 | 42 | 35 | 10.0 | 0.13 | 0.60 |
| 47 | 0.020 | 0.9 | 0.48 | *1.8 | 89 | 26 | 45 | 9.5 | 0.24 | 0.70 |
| 48 | 0.027 | 1.3 | 0.35 | 0.3 | *20 | 18 | 36 | 9.0 | 0.28 | 1.00 |
| 49 | 0.008 | 1.1 | 0.66 | 0.15 | *285 | 60 | 48 | 8.5 | 0.38 | 1.00 |
| 50 | 0.015 | 0.9 | 0.75 | −0.2 | 95 | *70 | 56 | 9.5 | 1.30 | 0.00 |
| 51 | 0.023 | 0.8 | 0.57 | 0.15 | 102 | 26 | *92 | 10.5 | 1.90 | 0.00 |
| 52 | 0.029 | 0.7 | 0.46 | −0.35 | 112 | 31 | 29 | *6.5 | 1.50 | 0.00 |

Remarks
(1) Hole rejection ratio:ratio of poor etched hole generated.
(2) Rejection due to baking in annealing before pressing:inconvenience of adhesing plate surfaces in the annealing before pressing.
Result in the production of highly fine shadow mask having a pitch of 0.28 mm.

Example 3

The same experiment as in Example 1 is carried out with respect to shadow mask materials of Fe—Ni—Co based alloys shown in Table 8 . The results are shown in Table 9. In this case, results similar to those of Fe—Ni based shadow mask materials are obtained.

TABLE 8

| Composition (wt %) | | | | |
|---|---|---|---|---|
| Ni | C | Si | Co | Fe |
| 32 | 0.4 | 0.04 | 3.5 | balance |

Example 5

In this example, the combination of various factors is examined in order to more improve the yield and the like though shadow mask materials capable of sufficiently satisfying the quality and product yield as compared with those of the conventional shadow mask material are provided when the X-ray intensity ratio, intensity distribution of Ni segregation in the section direction and section cleanness are within adequate ranges. The results are shown in Table 10.

Table 10 shows a relationship among the section cleanness, surface roughness (Ra, Rsk, Sm, Rθ), number of inclusions having a size of not less than 10 μm at plane and section, grain size number, presence or absence of baking in the annealing before the pressing and hole rejection ratio. As a surface roughness meter is used a SURFCOM 1500A

TABLE 9

| | Section cleanness (%) | X-ray intensity ratio (100)<001>/(221)<212> | Ra μm | Rsk | Sm μm | Number of inclusions on surface/100 mm² | Number of inclusions at section/100 mm² | Grain size number | Hole rejection ratio (%) | Rejection ratio due to baking in annealing before pressing | Grade of streak | Grade of mottling |
|---|---|---|---|---|---|---|---|---|---|---|---|---|
| Invention examples | | | | | | | | | | | | |
| 61 | 0.008 | 2.1 | 0.5 | 0.4 | 100 | 7 | 8 | 10 | 0.0 | 0.0 | 5 | 5 |
| 62 | 0.008 | 2.2 | 0.6 | 0.5 | 55 | 9 | 7 | 9 | 0.0 | 0.0 | 5 | 5 |
| 63 | 0.017 | 2.8 | 0.6 | 0.9 | 150 | 7 | 5 | 10 | 0.0 | 0.0 | 5 | 5 |
| Reference examples | | | | | | | | | | | | |
| 64 | 0.008 | 2.2 | *1.2 | 0.5 | 102 | 12 | 10 | 9.5 | 0.1 | 0.2 | 5 | 5 |
| 65 | 0.008 | 2.2 | *0.1 | 0.2 | 43 | 15 | 15 | 9.5 | 0.1 | 0.1 | 4 | 4 |
| 66 | 0.017 | 2.5 | 0.5 | −0.4 | 32 | 20 | 40 | 9 | 0.2 | 0.1 | 5 | 5 |
| 67 | 0.008 | 2.3 | 0.6 | 0.2 | *15 | 15 | 14 | 9.5 | 0.1 | 0.1 | 5 | 4 |
| 68 | 0.008 | 2.8 | 0.6 | 1.0 | *270 | 62 | 21 | 9 | 0.2 | 0.1 | 5 | |
| 69 | 0.021 | 3.0 | 0.5 | 0.9 | 30 | *80 | 12 | 10 | 0.1 | 0.1 | 4 | 4 |
| 70 | 0.008 | 2.3 | 0.6 | 0.4 | 21 | 8 | *90 | 9.5 | 0.7 | 0.2 | 5 | 4 |
| 71 | 0.008 | 2.4 | 0.7 | 0.3 | 200 | 20 | 20 | *5 | 0.6 | 0.1 | 4 | 5 |
| Comparative examples | | | | | | | | | | | | |
| 72 | 0.017 | *0.4 | 0.7 | 0.2 | 120 | 10 | 40 | 9.5 | — | — | 2 | 3 |
| 73 | 0.021 | *5.4 | 0.6 | 0.9 | 100 | 15 | 20 | 10 | — | — | 2 | 5 |
| 74 | *0.07 | 2.2 | 0.5 | 0.2 | 106 | 17 | 20 | 9 | 1.1 | — | 4 | 4 |

Evaluated with respect to materials having a thickness of 0.13 mm.
Evaluation standard and the like of each item are the same as in Table 4 and 7.

made by Tokyo Seimitsu Co., Ltd. As a result, the following facts are confirmed.

① When the section cleanness exceeds 0.05%, the hole rejection ratio becomes somewhat higher (No. 84).

② When the number of inclusions having a size of not less than 10 μm observed at the plane and section exceeds 65 and 80, respectively, per unit area, it is confirmed to somewhat increase the occurrence of poor holes (No. 92, 93).

③ As the grain size number is not more than 7.0, the hole rejection ratio somewhat increases, because individual crystal grains are large and have an opening shape dependent upon each crystal orientation and it is relatively difficult to form uniform holes (No. 94).

④ As mentioned above, the adequate surface roughness enhances the resist application before the etching, and adhesion property of the resist at the light exposure step and improves the vacuum suction and plays a role for preventing halation through the light exposure, and prevents the adhesion between shadow masks in the annealing before the pressing and hence prevents the streak of the black (oxide) film through the adhesion. In order to prove these facts, it is confirmed that the blackened streak is caused due to the hole rejection ratio resulted from the etching or the baking (adhesion between the plates in the annealing before the pressing) in accordance with the combination of Ra, Rsk, Sm and Rθ (No. 85, 86, 87, 88, 89, 90, 91).

TABLE 10

| | Section cleanness (%) | X-ray intensity ratio (100)<001>/(221)<212> | Ra μm | Rsk | Sm μm | Rθa | Number of inclusions on surface/100 mm² | Number of inclusions at section/100 mm² | Grain size number | Hole rejection ratio (%) | Rejection ratio due to baking in annealing before pressing (%) |
|---|---|---|---|---|---|---|---|---|---|---|---|
| 81 | 0.008 | 2.2 | 0.55 | 0.5 | 105 | 0.025 | 7 | 19 | 10.5 | 0.00 | 0.00 |
| 82 | 0.017 | 2.0 | 0.43 | 0.1 | 55 | 0.030 | 15 | 42 | 10.0 | 0.03 | 0.00 |
| 83 | 0.030 | 1.9 | 0.73 | 0.9 | 156 | 0.045 | 30 | 59 | 10.5 | 0.02 | 0.00 |
| 84 | *0.06 | 2.3 | 0.45 | −0.2 | 65 | 0.035 | 25 | 25 | 9.0 | 0.15 | 0.00 |
| 85 | 0.025 | 1.8 | 1.0 | 0.5 | 102 | 0.028 | 30 | 28 | 9.5 | 0.26 | 0.50 |
| 86 | 0.015 | 2.0 | 0.55 | −0.8 | 115 | 0.044 | 42 | 35 | 10.0 | 0.13 | 0.60 |
| 87 | 0.020 | 1.9 | 0.48 | 1.8 | 89 | 0.050 | 26 | 45 | 9.5 | 0.24 | 0.70 |
| 88 | 0.027 | 2.3 | 0.35 | 0.3 | 20 | 0.052 | 18 | 36 | 9.0 | 0.28 | 1.00 |
| 89 | 0.008 | 2.1 | 0.66 | 0.15 | 285 | 0.028 | 22 | 48 | 8.5 | 0.38 | 1.00 |
| 90 | 0.025 | 2.5 | 0.45 | 0.25 | 175 | 0.005 | 24 | 32 | 10.0 | 0.22 | 0.95 |
| 91 | 0.032 | 1.7 | 0.50 | 0.1 | 45 | 0.095 | 60 | 53 | 10.0 | 0.25 | 1.50 |
| 92 | 0.015 | 1.9 | 0.75 | −0.2 | 95 | 0.035 | 72 | 56 | 9.5 | 1.30 | 0.00 |
| 93 | 0.023 | 1.8 | 0.57 | 0.15 | 102 | 0.045 | 26 | 92 | 10.5 | 1.90 | 0.00 |
| 94 | 0.029 | 1.7 | 0.46 | −0.35 | 112 | 0.042 | 31 | 29 | 6.5 | 1.50 | 0.00 |

Remarks
(1) Hole rejection ratio:ratio of poor etched hole generated.
(2) Rejection due to baking in annealing before pressing:inconvenience of adhesing plate surfaces in the annealing before pressing.
Measured on materials having $C_{Ni}S$ of not more than 0.1% and $C_{Ni}max$ of not more than 0.5%.

INDUSTRIAL APPLICABILITY

As mentioned above, according to the invention, there can be provided Fe—Ni alloy and Fe—Ni—Co alloy being excellent in the etching property, particularly low thermal expansion type Fe—Ni based shadow mask materials not causing streak or mottling in the etching. Therefore, such materials can surely provide materials for color cathode tube or display developing a beautiful image in a higher yield.

What is claimed is:

1. A Fe—Ni based material for shadow mask of an iron-nickel alloy containing Ni: 34–38 wt %, characterized in that the material has a texture that an X-ray intensity ratio Ir of cubic orientation (100)<001> to twinning orientation (221)<212> thereof in a (111) pole figure is a range of 0.5–5:1 and a section cleanness defined according to JIS G0555 is not more than 0.05%.

2. A Fe—Ni based material for shadow mask of an iron-nickel alloy having a composition of C: not more than 0.1 wt %, Si: not more than 0.5 wt %, Mn: not more than 1.0 wt %, Ni: 34–38 wt % and the remainder being substantially Fe, characterized in that the material has a texture that an X-ray intensity ratio Ir of cubic orientation (100)<001> to twinning orientation (221)<212> thereof in a (111) pole figure is a range of 0.5–5:1 and a section cleanness defined according to JIS G0555 is not more than 0.05%.

3. A Fe—Ni—Co based material for shadow mask of an iron-nickel-cobalt alloy having a composition of Ni: 23–38 wt %, Co: not more than 10 wt % and the remainder being substantially Fe, characterized in that the material has a texture that an X-ray intensity ratio Ir of cubic orientation (100)<001> to twinning orientation (221)<212> thereof in a (111) pole figure is a range of 0.5–5:1 and a section cleanness defined according to JIS G0555 is not more than 0.05%.

4. A material for shadow mask according to claim 1, wherein a parameter Ra relating to a surface roughness is 0.2 μm≦Ra≦0.9 μm.

5. A material for shadow mask according to claim 1, wherein a parameter Sm relating to a surface roughness is 20 μm≦Sm≦250 μm.

6. A material for shadow mask according to claim 1, wherein a parameter Rsk relating to a surface roughness is −0.5≦Rsk≦1.3.

7. A material for shadow mask according to claim 1, wherein the number of inclusions having a size of not less than 10 μm at a position polished from a plate surface to an arbitrary depth is not more than 65 per unit area of 100 mm².

8. A material for shadow mask according to claim 1, wherein the number of inclusions having a size of not less than 10 μm measured at a plate section is not more than 80 per unit area of 100 mm².

9. A Fe—Ni based material for shadow mask according to claim 1, wherein a grain size number measured according to a method of JIS G0551 is not less than 7.0.

10. A Fe—Ni based material for shadow mask of an iron-nickel-alloy containing Ni: 34–38 wt %, Si: not more than 0.5 wt %, Mn: not more than 1.0 wt % and P: not more than 0.1 wt %, characterized in that the material has a texture that an X-ray intensity ratio Ir of cubic orientation (100)<001> to twinning orientation (221)<212> thereof in a (111) pole figure is a range of 0.5–5:1 and a Ni segregation amount $C_{Ni}s$ in a thickness direction is not more than 0.30% and a maximum Ni segregation amount $C_{Ni}max$ is not more than 1.5%.

11. A Fe—Ni based material for shadow mask according to claim 10, wherein a Si segregation amount $C_{Si}s$ in the thickness direction is not more than 0.004% and a maximum Si segregation amount $C_{Si}max$ is not more than 0.01%.

12. A Fe—Ni based material for shadow mask according to claim 10, wherein a Mn segregation amount $C_{Mn}s$ in the thickness direction is not more than 0.030% and a maximum Mn segregation amount $C_{Mn}max$ is not more than 0.05%.

13. A Fe—Ni based material for shadow mask according to claim 10, wherein a P segregation amount $C_{P}s$ in the thickness direction is not more than 0.001% and a maximum P segregation amount $C_{P}max$ is not more than 0.005%.

14. A Fe—Ni based material for shadow mask according to claim 10, wherein a parameter Ra relating to a surface roughness is $0.2\ \mu m \leqq Ra \leqq 0.9\ \mu m$.

15. A Fe—Ni based material for shadow mask according to claim 10, wherein a parameter Sm relating to a surface roughness is $20\ \mu m \leqq Sm \leqq 250\ \mu m$.

16. A Fe—Ni based material for shadow mask according to claim 10, wherein a parameter Rsk relating to a surface roughness is $-0.5 \leqq Rsk \leqq 1.3$.

17. A Fe—Ni based material for shadow mask according to claim 10, wherein a parameter Rθa relating to a surface roughness is $0.01 \leqq R\theta a \leqq 0.09$.

18. A Fe—Ni based material for shadow mask according to claim 10, wherein a section cleanness defined according to JIS G0551 is not more than 0.05%.

19. A Fe—Ni based material for shadow mask according to claim 10, wherein the number of inclusions having a size of not less than 10 $\mu$m at a position polished from a plate surface to an arbitrary depth is not more than 65 per unit area of 100 $mm^2$.

20. A Fe—Ni based material for shadow mask according to claim 10, wherein the number of inclusions having a size of not less than 10 $\mu$m measured at a plate section is not more than 80 per unit area of 100 $mm^2$.

21. A Fe—Ni based material for shadow mask according to claim 10, wherein a grain size number measured according to a method of JIS G0551 is not less than 7.0.

* * * * *